US009478847B2

(12) United States Patent
Russell et al.

(10) Patent No.: US 9,478,847 B2
(45) Date of Patent: Oct. 25, 2016

(54) ANTENNA SYSTEM AND METHOD OF ASSEMBLY FOR A WEARABLE ELECTRONIC DEVICE

(71) Applicant: GOOGLE TECHNOLOGY HOLDINGS LLC, Mountain View, CA (US)

(72) Inventors: Michael E. Russell, Lake Zurich, IL (US); Katherine H. Coles, Geneva, IL (US); Abu T. Sayem, Gurnee, IL (US)

(73) Assignee: Google Technology Holdings LLC, Mountain View, CA (US)

( * ) Notice: Subject to any disclaimer, the term of this patent is extended or adjusted under 35 U.S.C. 154(b) by 33 days.

(21) Appl. No.: 14/339,476

(22) Filed: Jul. 24, 2014

(65) Prior Publication Data

US 2015/0349410 A1 Dec. 3, 2015

Related U.S. Application Data

(60) Provisional application No. 62/006,316, filed on Jun. 2, 2014, provisional application No. 62/016,884, filed on Jun. 25, 2014.

(51) Int. Cl.
*H01Q 13/10* (2006.01)
*H01Q 1/27* (2006.01)
(Continued)

(52) U.S. Cl.
CPC ..... *H01Q 1/273* (2013.01); *G04G 21/04* (2013.01); *H01Q 13/10* (2013.01); *G04R 60/06* (2013.01); *Y10T 29/4902* (2015.01)

(58) Field of Classification Search
CPC ..... H01Q 1/273; H01Q 13/10; G04R 60/06
See application file for complete search history.

(56) References Cited

U.S. PATENT DOCUMENTS 4,612,669 A 9/1986 Nossen
4,631,543 A 12/1986 Brodeur
4,754,285 A * 6/1988 Robitaille ..... H01Q 1/44 343/718

(Continued)

FOREIGN PATENT DOCUMENTS

CN 1762137 4/2006
CN 1859656 11/2006

(Continued)

OTHER PUBLICATIONS

European Patent Office, International Search Report and the Written Opinion in International Patent Application PCT/US2015/031328 (Aug. 12, 2015).

(Continued)

*Primary Examiner* — Trinh Dinh
(74) *Attorney, Agent, or Firm* — Wolfe-SBMC

(57) ABSTRACT

An antenna system for a wearable electronic device includes a first conductive surface constructed from a segment of outer housing of the wearable electronic device. The first conductive surface spans a first axis through the wearable electronic device. The antenna system also includes a second conductive surface that spans the first axis. The second conductive surface is constructed from a set of contacting metal components that are internal to the wearable electronic device. The first and second conductive surfaces are separated by a space. The antenna system also has a contact element having a feeding element that connects the first conductive surface to the second conductive surface along a plane that is normal to the first conductive surface.

20 Claims, 9 Drawing Sheets

(51) Int. Cl.
*G04G 21/04* (2013.01)
*G04R 60/06* (2013.01)

(56) References Cited

U.S. PATENT DOCUMENTS 4,884,252 A * 11/1989 Teodoridis ..... H01Q 1/44 343/718
5,267,234 A 11/1993 Harrison
5,459,440 A 10/1995 Claridge et al.
5,564,086 A 10/1996 Cygan et al.
5,634,200 A 5/1997 Kitakubo et al.
5,699,319 A 12/1997 Skrivervik
5,757,326 A 5/1998 Koyama et al.
5,804,944 A 9/1998 Alberkrack et al.
5,862,458 A 1/1999 Ishii
6,144,186 A 11/2000 Thadiwe et al.
6,339,758 B1 1/2002 Kanazawa et al.
6,362,690 B1 3/2002 Tichauer
6,373,439 B1 4/2002 Zurcher et al.
6,400,702 B1 6/2002 Meier
6,560,444 B1 5/2003 Imberg
6,594,508 B1 7/2003 Ketonen
6,674,291 B1 1/2004 Barber et al.
6,879,942 B1 4/2005 Nagase et al.
6,927,555 B2 8/2005 Johnson
6,937,980 B2 8/2005 Krasny et al.
7,019,702 B2 * 3/2006 Henriet ..... H01Q 1/273 343/718
7,142,884 B2 11/2006 Hagn
7,199,754 B2 4/2007 Krumm et al.
7,202,734 B1 4/2007 Raab
7,202,815 B2 4/2007 Swope et al.
7,260,366 B2 8/2007 Lee et al.
7,359,504 B1 4/2008 Reuss et al.
7,400,907 B2 7/2008 Jin et al.
7,433,661 B2 10/2008 Kogiantis et al.
7,436,896 B2 10/2008 Hottinen et al.
7,440,731 B2 10/2008 Staudinger et al.
7,471,963 B2 12/2008 Kim et al.
7,486,931 B2 2/2009 Cho et al.
7,504,833 B1 3/2009 Sequine
7,599,420 B2 10/2009 Forenza et al.
D606,958 S 12/2009 Knoppert et al.
7,639,660 B2 12/2009 Kim et al.
7,649,831 B2 1/2010 Van Rensburg et al.
7,664,200 B2 2/2010 Ariyavisitakul et al.
7,746,943 B2 6/2010 Yamaura
7,760,681 B1 7/2010 Chhabra
7,773,535 B2 8/2010 Vook et al.
7,773,685 B2 8/2010 Tirkkonen et al.
7,822,140 B2 10/2010 Catreux et al.
7,835,711 B2 11/2010 McFarland
7,839,201 B2 11/2010 Jacobson
7,864,969 B1 1/2011 Ma et al.
7,885,211 B2 2/2011 Shen et al.
7,936,237 B2 5/2011 Park et al.
7,940,740 B2 5/2011 Krishnamurthy et al.
7,942,936 B2 5/2011 Golden
7,945,229 B2 5/2011 Wilson et al.
8,014,455 B2 9/2011 Kim et al.
8,072,285 B2 12/2011 Spears et al.
8,094,011 B2 1/2012 Faris et al.
8,098,120 B2 1/2012 Steeneken et al.
8,155,683 B2 4/2012 Buckley et al.
8,204,446 B2 6/2012 Scheer et al.
8,219,336 B2 7/2012 Hoebel et al.
8,219,337 B2 7/2012 Hoebel et al.
8,232,685 B2 7/2012 Perper et al.
8,233,851 B2 7/2012 Jeon et al.
8,244,317 B2 8/2012 Knoppert et al.
8,259,431 B2 9/2012 Katta
8,275,327 B2 9/2012 Yi et al.
8,280,323 B2 10/2012 Thompson
8,284,849 B2 10/2012 Lee et al.
8,302,183 B2 10/2012 Sood
8,319,393 B2 11/2012 DeReus
8,373,596 B1 2/2013 Kimball et al.
8,374,633 B2 2/2013 Frank et al.
8,384,695 B2 2/2013 Lee et al.
8,428,022 B2 4/2013 Frank et al.
8,460,961 B2 6/2013 Guo et al.
8,483,707 B2 7/2013 Krishnamurthy et al.
8,509,338 B2 8/2013 Sayana et al.
8,542,776 B2 9/2013 Kim et al.
8,588,426 B2 11/2013 Xin et al.
8,594,584 B2 11/2013 Greene et al.
8,606,200 B2 12/2013 Ripley et al.
8,611,829 B2 12/2013 Alberth et al.
8,620,348 B2 12/2013 Shrivastava et al.
8,626,083 B2 1/2014 Greene et al.
8,712,340 B2 4/2014 Hoirup et al.
8,712,355 B2 4/2014 Black et al.
8,731,496 B2 5/2014 Drogi et al.
8,761,296 B2 6/2014 Zhang et al.
8,767,722 B2 7/2014 Kamble et al.
8,989,747 B2 3/2015 Padden et al.
9,002,354 B2 4/2015 Krishnamurthy et al.
9,031,523 B2 5/2015 Anderson
9,197,255 B2 11/2015 Pourkhaatoun et al.
9,203,489 B2 12/2015 Sayana et al.
9,215,659 B2 12/2015 Asrani et al.
9,241,050 B1 1/2016 Asrani et al.
9,298,303 B2 3/2016 Wagner et al.
9,301,177 B2 3/2016 Ballantyne et al.
9,326,320 B2 4/2016 Hong et al.
9,344,837 B2 5/2016 Russel et al.
9,386,542 B2 7/2016 Russell et al.
9,401,750 B2 7/2016 Sayana et al.
9,413,409 B2 8/2016 Black et al.
2001/0034238 A1 10/2001 Voyer
2002/0037742 A1 3/2002 Enderlein et al.
2002/0057751 A1 5/2002 Jagger et al.
2002/0090974 A1 7/2002 Hagn
2002/0138254 A1 9/2002 Isaka et al.
2002/0149351 A1 10/2002 Kanekawa et al.
2002/0193130 A1 12/2002 Yang et al.
2003/0143961 A1 7/2003 Humphreys et al.
2003/0161485 A1 8/2003 Smith
2003/0222819 A1 12/2003 Karr et al.
2004/0051583 A1 3/2004 Hellberg
2004/0052314 A1 3/2004 Copeland
2004/0052317 A1 3/2004 Love et al.
2004/0057530 A1 3/2004 Tarokh et al.
2004/0063439 A1 4/2004 Glazko et al.
2004/0082356 A1 4/2004 Walton et al.
2004/0106428 A1 6/2004 Shoji
2004/0148333 A1 7/2004 Manion et al.
2004/0176125 A1 9/2004 Lee
2004/0178912 A1 9/2004 Smith et al.
2004/0192398 A1 9/2004 Zhu
2004/0198392 A1 10/2004 Harvey et al.
2004/0235433 A1 11/2004 Hugl et al.
2004/0246048 A1 12/2004 Leyonhjelm et al.
2005/0037733 A1 2/2005 Coleman et al.
2005/0041018 A1 2/2005 Philipp
2005/0075123 A1 4/2005 Jin et al.
2005/0124393 A1 6/2005 Nuovo et al.
2005/0134456 A1 6/2005 Niu et al.
2005/0135324 A1 6/2005 Kim et al.
2005/0136845 A1 6/2005 Masuoka et al.
2005/0208952 A1 9/2005 Dietrich et al.
2005/0227640 A1 10/2005 Haque et al.
2005/0250532 A1 11/2005 Hwang et al.
2006/0019677 A1 1/2006 Teague et al.
2006/0052131 A1 3/2006 Ichihara
2006/0067277 A1 3/2006 Thomas et al.
2006/0077952 A1 4/2006 Kubsch et al.
2006/0099940 A1 5/2006 Pfleging et al.
2006/0103635 A1 5/2006 Park
2006/0181453 A1 8/2006 King et al.
2006/0194593 A1 8/2006 Drabeck et al.
2006/0207806 A1 9/2006 Philipp
2006/0209754 A1 9/2006 Ji et al.
2006/0215618 A1 9/2006 Soliman et al.

(56) References Cited

U.S. PATENT DOCUMENTS

2006/0240827 A1 10/2006 Dunn
2006/0245601 A1 11/2006 Michaud et al.
2006/0256887 A1 11/2006 Kwon et al.
2006/0280261 A1 12/2006 Prikhodko et al.
2006/0291393 A1 12/2006 Teague et al.
2006/0292990 A1 12/2006 Karabinis et al.
2007/0004344 A1 1/2007 DeGroot et al.
2007/0008108 A1 1/2007 Schurig et al.
2007/0026838 A1 2/2007 Staudinger et al.
2007/0042714 A1 2/2007 Ayed
2007/0049280 A1 3/2007 Sambhwani et al.
2007/0069735 A1 3/2007 Graf et al.
2007/0091004 A1 4/2007 Puuri
2007/0093281 A1 4/2007 Park et al.
2007/0133462 A1 6/2007 Guey
2007/0153743 A1 7/2007 Mukkavilli et al.
2007/0197180 A1 8/2007 McKinzie et al.
2007/0200766 A1 8/2007 McKinzie et al.
2007/0211657 A1 9/2007 McBeath et al.
2007/0211813 A1 9/2007 Talwar et al.
2007/0222629 A1 9/2007 Yoneyama
2007/0223422 A1 9/2007 Kim et al.
2007/0232370 A1 10/2007 Kim
2007/0238425 A1 10/2007 McFarland
2007/0238496 A1 10/2007 Chung et al.
2007/0243894 A1 10/2007 Das et al.
2007/0255558 A1 11/2007 Yasunaga et al.
2007/0280160 A1 12/2007 Kim et al.
2007/0285326 A1 12/2007 McKinzie
2008/0001915 A1 1/2008 Pihlaja et al.
2008/0002735 A1 1/2008 Poirier et al.
2008/0014960 A1 1/2008 Chou
2008/0026710 A1 1/2008 Buckley
2008/0080449 A1 4/2008 Huang et al.
2008/0089312 A1 4/2008 Malladi
2008/0095109 A1 4/2008 Malladi et al.
2008/0108310 A1 5/2008 Tong et al.
2008/0111714 A1 5/2008 Kremin
2008/0117886 A1 5/2008 Kim
2008/0130626 A1 6/2008 Ventola et al.
2008/0132247 A1 6/2008 Anderson
2008/0133462 A1 6/2008 Aylward et al.
2008/0157893 A1 7/2008 Krah
2008/0159239 A1 7/2008 Odlyzko et al.
2008/0165876 A1 7/2008 Suh et al.
2008/0167040 A1 7/2008 Khandekar et al.
2008/0167073 A1 7/2008 Hobson et al.
2008/0170602 A1 7/2008 Guey
2008/0170608 A1 7/2008 Guey
2008/0186105 A1 8/2008 Scuderi et al.
2008/0192683 A1 8/2008 Han et al.
2008/0212520 A1 9/2008 Chen et al.
2008/0225693 A1 9/2008 Zhang et al.
2008/0227414 A1 9/2008 Karmi et al.
2008/0227481 A1 9/2008 Naguib et al.
2008/0232395 A1 9/2008 Buckley et al.
2008/0267310 A1 10/2008 Khan et al.
2008/0274753 A1 11/2008 Attar et al.
2008/0279300 A1 11/2008 Walker et al.
2008/0298482 A1 12/2008 Rensburg et al.
2008/0307427 A1 12/2008 Pi et al.
2008/0309633 A1 12/2008 Hotelling et al.
2008/0313146 A1 12/2008 Wong et al.
2008/0317259 A1 12/2008 Zhang et al.
2009/0041151 A1 2/2009 Khan et al.
2009/0055170 A1 2/2009 Nagahama
2009/0061790 A1 3/2009 Rofougaran
2009/0061887 A1 3/2009 Hart et al.
2009/0067382 A1 3/2009 Li et al.
2009/0091551 A1 4/2009 Hotelling et al.
2009/0102294 A1 4/2009 Hodges et al.
2009/0121963 A1 5/2009 Greene
2009/0122758 A1 5/2009 Smith et al.
2009/0122884 A1 5/2009 Vook et al.
2009/0228598 A1 9/2009 Stamoulis et al.
2009/0238131 A1 9/2009 Montojo et al.
2009/0243631 A1 10/2009 Kuang
2009/0252077 A1 10/2009 Khandekar et al.
2009/0256644 A1 10/2009 Knudsen
2009/0258614 A1 10/2009 Walker
2009/0262699 A1 10/2009 Wdngerter et al.
2009/0264078 A1 10/2009 Yun et al.
2009/0268675 A1 10/2009 Choi
2009/0270103 A1 10/2009 Pani et al.
2009/0285321 A1 11/2009 Schulz et al.
2009/0290544 A1 11/2009 Yano et al.
2009/0295226 A1 12/2009 Hodges et al.
2009/0298433 A1 12/2009 Sorrells et al.
2009/0323608 A1 12/2009 Adachi et al.
2010/0002657 A1 1/2010 Teo et al.
2010/0014690 A1 1/2010 Wolff et al.
2010/0023898 A1 1/2010 Nomura et al.
2010/0034312 A1 2/2010 Muharemovic et al.
2010/0035627 A1 2/2010 Hou et al.
2010/0046460 A1 2/2010 Kwak et al.
2010/0046650 A1 2/2010 Jongren et al.
2010/0056166 A1 3/2010 Tenny
2010/0081487 A1 4/2010 Chen et al.
2010/0085010 A1 4/2010 Suzuki et al.
2010/0103949 A1 4/2010 Jung et al.
2010/0106459 A1 4/2010 Bakalov
2010/0109796 A1 5/2010 Park et al.
2010/0118706 A1 5/2010 Parkvall et al.
2010/0118839 A1 5/2010 Malladi et al.
2010/0156728 A1 6/2010 Alvey et al.
2010/0157858 A1 6/2010 Lee et al.
2010/0157924 A1 6/2010 Prasad et al.
2010/0159833 A1 6/2010 Lewis et al.
2010/0161658 A1 6/2010 Hamynen et al.
2010/0165882 A1 7/2010 Palanki et al.
2010/0167743 A1 7/2010 Palanki et al.
2010/0172310 A1 7/2010 Cheng et al.
2010/0172311 A1 7/2010 Agrawal et al.
2010/0182903 A1 7/2010 Palanki et al.
2010/0189191 A1 7/2010 Taoka et al.
2010/0195566 A1 8/2010 Krishnamurthy et al.
2010/0208838 A1 8/2010 Lee et al.
2010/0217590 A1 8/2010 Nemer et al.
2010/0220801 A1 9/2010 Lee et al.
2010/0260154 A1 10/2010 Frank et al.
2010/0271330 A1 10/2010 Philipp
2010/0272094 A1 10/2010 Byard et al.
2010/0274516 A1 10/2010 Hoebel et al.
2010/0291918 A1 11/2010 Suzuki et al.
2010/0311437 A1 12/2010 Palanki et al.
2010/0317343 A1 12/2010 Krishnamurthy
2010/0322176 A1 12/2010 Chen et al.
2010/0323718 A1 12/2010 Jen
2011/0039583 A1 2/2011 Frank et al.
2011/0051834 A1 3/2011 Lee et al.
2011/0080969 A1 4/2011 Jongren et al.
2011/0083066 A1 4/2011 Chung et al.
2011/0085588 A1 4/2011 Zhuang
2011/0085610 A1 4/2011 Zhuang et al.
2011/0096739 A1 4/2011 Heidari et al.
2011/0096915 A1 4/2011 Nemer
2011/0103498 A1 5/2011 Chen et al.
2011/0105023 A1 5/2011 Scheer
2011/0116423 A1 5/2011 Rousu et al.
2011/0116436 A1 5/2011 Bachu et al.
2011/0117925 A1 5/2011 Sampath et al.
2011/0119005 A1 5/2011 Majima et al.
2011/0121836 A1 5/2011 Kim et al.
2011/0143770 A1 6/2011 Charbit et al.
2011/0143773 A1 6/2011 Kangas et al.
2011/0148625 A1 6/2011 Velusamy
2011/0148700 A1 6/2011 Lasagabaster et al.
2011/0149868 A1 6/2011 Krishnamurthy et al.
2011/0149903 A1 6/2011 Krishnamurthy et al.
2011/0157067 A1 6/2011 Wagner et al.
2011/0158200 A1 6/2011 Bachu et al.
2011/0176252 A1 7/2011 DeReus
2011/0189964 A1 8/2011 Jeon et al.
2011/0190016 A1 8/2011 Hamabe et al.

(56) References Cited

U.S. PATENT DOCUMENTS

| | | | |
|---|---|---|---|
| 2011/0216840 | A1 | 9/2011 | Lee et al. |
| 2011/0244884 | A1 | 10/2011 | Kangas et al. |
| 2011/0249637 | A1 | 10/2011 | Hammarwall et al. |
| 2011/0250852 | A1 | 10/2011 | Greene |
| 2011/0268101 | A1 | 11/2011 | Wang |
| 2011/0274188 | A1 | 11/2011 | Sayana et al. |
| 2011/0281532 | A1 | 11/2011 | Shin et al. |
| 2011/0285603 | A1 | 11/2011 | Skarp |
| 2011/0286349 | A1 | 11/2011 | Tee et al. |
| 2011/0292844 | A1 | 12/2011 | Kwun et al. |
| 2011/0319027 | A1 | 12/2011 | Sayana |
| 2012/0002609 | A1 | 1/2012 | Larsson et al. |
| 2012/0008510 | A1 | 1/2012 | Cai et al. |
| 2012/0021769 | A1 | 1/2012 | Lindoff et al. |
| 2012/0032646 | A1 | 2/2012 | Lee |
| 2012/0039251 | A1 | 2/2012 | Sayana |
| 2012/0050122 | A1 | 3/2012 | Wu et al. |
| 2012/0052903 | A1 | 3/2012 | Han et al. |
| 2012/0071195 | A1 | 3/2012 | Chakraborty et al. |
| 2012/0076043 | A1 | 3/2012 | Nishio et al. |
| 2012/0077538 | A1 | 3/2012 | Yun |
| 2012/0106475 | A1 | 5/2012 | Jung |
| 2012/0112851 | A1 | 5/2012 | Manssen et al. |
| 2012/0120772 | A1 | 5/2012 | Fujisawa |
| 2012/0120934 | A1 | 5/2012 | Cho |
| 2012/0122478 | A1 | 5/2012 | Siomina et al. |
| 2012/0158839 | A1 | 6/2012 | Hassan et al. |
| 2012/0161927 | A1 | 6/2012 | Pierfelice et al. |
| 2012/0162129 | A1 | 6/2012 | Krah et al. |
| 2012/0170541 | A1 | 7/2012 | Love et al. |
| 2012/0177089 | A1 | 7/2012 | Pelletier et al. |
| 2012/0182144 | A1 | 7/2012 | Richardson et al. |
| 2012/0206556 | A1 | 8/2012 | Yu et al. |
| 2012/0214412 | A1 | 8/2012 | Schlub et al. |
| 2012/0214421 | A1 | 8/2012 | Hoirup et al. |
| 2012/0220243 | A1 | 8/2012 | Mendolia |
| 2012/0224715 | A1 | 9/2012 | Kikkeri |
| 2012/0295554 | A1 | 11/2012 | Greene et al. |
| 2012/0295555 | A1 | 11/2012 | Greene et al. |
| 2012/0302188 | A1 | 11/2012 | Sahota et al. |
| 2012/0306716 | A1 | 12/2012 | Satake et al. |
| 2012/0309388 | A1 | 12/2012 | Moosavi et al. |
| 2012/0309413 | A1 | 12/2012 | Grosman et al. |
| 2012/0316967 | A1 | 12/2012 | Mgrdechian et al. |
| 2013/0030803 | A1 | 1/2013 | Liao |
| 2013/0034241 | A1 | 2/2013 | Pandey et al. |
| 2013/0039284 | A1 | 2/2013 | Marinier et al. |
| 2013/0040578 | A1 | 2/2013 | Khoshnevis et al. |
| 2013/0059600 | A1 | 3/2013 | Elsom-Cook et al. |
| 2013/0078980 | A1 | 3/2013 | Saito |
| 2013/0094484 | A1 | 4/2013 | Kneckt et al. |
| 2013/0109314 | A1 | 5/2013 | Kneckt et al. |
| 2013/0109334 | A1 | 5/2013 | Kwon et al. |
| 2013/0142113 | A1 | 6/2013 | Fong et al. |
| 2013/0150092 | A1 | 6/2013 | Frank et al. |
| 2013/0178175 | A1 | 7/2013 | Kato |
| 2013/0194154 | A1 | 8/2013 | Baliarda et al. |
| 2013/0195296 | A1 | 8/2013 | Merks |
| 2013/0231151 | A1 | 9/2013 | Kneckt et al. |
| 2013/0286937 | A1 | 10/2013 | Liu et al. |
| 2013/0307735 | A1 | 11/2013 | Contreras et al. |
| 2013/0310102 | A1 | 11/2013 | Chao et al. |
| 2013/0316687 | A1 | 11/2013 | Subbaramoo et al. |
| 2013/0322375 | A1 | 12/2013 | Chang et al. |
| 2013/0322562 | A1 | 12/2013 | Zhang et al. |
| 2013/0322655 | A1 | 12/2013 | Schuldt et al. |
| 2013/0325149 | A1 | 12/2013 | Manssen et al. |
| 2014/0024321 | A1 | 1/2014 | Zhu et al. |
| 2014/0044126 | A1 | 2/2014 | Sabhanatarajan et al. |
| 2014/0045422 | A1 | 2/2014 | Qi et al. |
| 2014/0068288 | A1 | 3/2014 | Robinson et al. |
| 2014/0092830 | A1 | 4/2014 | Chen et al. |
| 2014/0093091 | A1 | 4/2014 | Dusan et al. |
| 2014/0177686 | A1 | 6/2014 | Greene et al. |
| 2014/0185498 | A1 | 7/2014 | Schwent et al. |
| 2014/0227981 | A1 | 8/2014 | Pecen et al. |
| 2014/0273882 | A1 | 9/2014 | Asrani et al. |
| 2014/0273886 | A1 | 9/2014 | Black et al. |
| 2014/0313088 | A1 | 10/2014 | Rozenblit et al. |
| 2014/0349593 | A1 | 11/2014 | Danak et al. |
| 2014/0376652 | A1 | 12/2014 | Sayana et al. |
| 2014/0379332 | A1 | 12/2014 | Rodriguez et al. |
| 2015/0017978 | A1 | 1/2015 | Hong et al. |
| 2015/0024786 | A1 | 1/2015 | Asrani et al. |
| 2015/0031420 | A1 | 1/2015 | Higaki et al. |
| 2015/0072632 | A1 | 3/2015 | Pourkhaatoun et al. |
| 2015/0080047 | A1 | 3/2015 | Russell et al. |
| 2015/0171919 | A1 | 6/2015 | Ballantyne et al. |
| 2015/0181388 | A1 | 6/2015 | Smith |
| 2015/0236828 | A1 | 8/2015 | Park et al. |
| 2015/0245323 | A1 | 8/2015 | You et al. |
| 2015/0280876 | A1 | 10/2015 | You et al. |
| 2015/0312058 | A1 | 10/2015 | Black et al. |
| 2015/0365065 | A1 | 12/2015 | Higaki et al. |
| 2016/0014727 | A1 | 1/2016 | Nimbalker |
| 2016/0036482 | A1 | 2/2016 | Black et al. |
| 2016/0080053 | A1 | 3/2016 | Sayana et al. |

FOREIGN PATENT DOCUMENTS

| | | |
|---|---|---|
| CN | 1984476 | 6/2007 |
| CN | 101035379 | 9/2007 |
| CN | 102638609 | 8/2012 |
| CN | 102664861 | 9/2012 |
| DE | 10053205 | 5/2002 |
| DE | 10118189 | 11/2002 |
| EP | 0695059 | 1/1996 |
| EP | 1158686 | 11/2001 |
| EP | 1298809 | 4/2003 |
| EP | 1357543 | 10/2003 |
| EP | 1511010 | 3/2005 |
| EP | 1753152 | 2/2007 |
| EP | 1443791 | 2/2009 |
| EP | 2487967 | 8/2012 |
| EP | 2255443 | 11/2012 |
| EP | 2557433 | 2/2013 |
| EP | 2568531 | 3/2013 |
| EP | 2590258 | 5/2013 |
| JP | H09247852 | 9/1997 |
| JP | 2000286924 | 10/2000 |
| KR | 20050058333 | 6/2005 |
| RU | 2005113251 | 1/2006 |
| WO | WO-9306682 | 4/1993 |
| WO | WO-9416517 | 7/1994 |
| WO | WO-9600401 | 1/1996 |
| WO | WO-9921389 | 4/1999 |
| WO | WO-9950968 | 10/1999 |
| WO | WO-0111721 | 2/2001 |
| WO | WO-03007508 | 1/2003 |
| WO | WO-03107327 | 12/2003 |
| WO | WO-2004021634 | 3/2004 |
| WO | WO-2004040800 | 5/2004 |
| WO | WO-2004084427 | 9/2004 |
| WO | WO-2004084447 | 9/2004 |
| WO | WO-2006039434 | 4/2006 |
| WO | WO-2006046192 | 5/2006 |
| WO | WO-2006130278 | 12/2006 |
| WO | WO-2007052115 | 5/2007 |
| WO | WO-2007080727 | 7/2007 |
| WO | WO-2008027705 | 3/2008 |
| WO | WO-2008033117 | 3/2008 |
| WO | WO-2008085107 | 7/2008 |
| WO | WO-2008085416 | 7/2008 |
| WO | WO-2008085720 | 7/2008 |
| WO | WO-2008112849 | 9/2008 |
| WO | WO-2008113210 | 9/2008 |
| WO | WO-2008137354 | 11/2008 |
| WO | WO-2008137607 | 11/2008 |
| WO | WO-2008156081 | 12/2008 |
| WO | WO-2009107090 | 9/2009 |
| WO | WO-2010080845 | 7/2010 |
| WO | WO-2010124244 | 10/2010 |
| WO | WO-2010138039 | 12/2010 |
| WO | WO-2012115649 | 8/2012 |

(56) References Cited

FOREIGN PATENT DOCUMENTS

| | | |
|---|---|---|
| WO | WO-2012149968 | 11/2012 |
| WO | WO-2012177939 | 12/2012 |
| WO | WO-2013131268 | 9/2013 |

OTHER PUBLICATIONS

"Corrected Notice of Allowance", U.S. Appl. No. 14/031,739, Jun. 8, 2016, 2 pages.
"Coverage enhancement for RACH messages", 3GPP TSG-RAN WG1 Meeting #76, R1-140153, Alcatel-Lucent, Alcatel-Lucent Shanghai Bell, Feb. 2014, 5 pages.
"Coverage Improvement for PRACH", 3GPP TSG RAN WG1 Meeting #76—R1-140115, Intel Corporation, Feb. 2014, 9 pages.
"Final Office Action", U.S. Appl. No. 13/692,520, May 26, 2016, 25 pages.
"Final Office Action", U.S. Appl. No. 13/955,723, Jun. 16, 2016, 31 pages.
"Final Office Action", U.S. Appl. No. 14/330,317, Jun. 16, 2016, 15 pages.
"International Search Report and Written Opinion", Application No. PCT/US2015/033570, Oct. 19, 2015, 18 pages.
"Non-Final Office Action", U.S. Appl. No. 13/721,771, May 31, 2016, 9 pages.
"On the need of PDCCH for SIB, RAR and Paging", 3GPP TSG-RAN WG1 #76—R1-140239, Feb. 2014, 4 pages.
"Specification Impact of Enhanced Filtering for Scalable UMTS", 3GPP TSG RAN WG1 Meeting #76, R1-140726, QUALCOMM Incorporated, Feb. 2014, 2 pages.
"Supplemental Notice of Allowance", U.S. Appl. No. 14/031,739, Apr. 21, 2016, 2 pages.
"Supplemental Notice of Allowance", U.S. Appl. No. 14/952,738, Jun. 9, 2016, 4 pages.
"Written Opinion", Application No. PCT/US2013/071616, Jun. 3, 2015, 9 pages.
Yu-chun,"A New Downlink Control Channel Scheme for LTE", Vehicular Technology Conference (VTC Spring), 2013 IEEE 77th, Jun. 2, 2013, 6 pages.
"3rd Generation Partnership Project; Technical Specification Group Radio Access Network", 3GPP TR 36.814 V9.0.0 (Mar. 2010), Further Advancements for E-UTRA.
Physical Layer Aspects (Release 9), Mar. 2010, 104 pages.
"A feedback framework based on W2W1 for Rei. 10", 3GPP TSG RAN WG1 #61bis, R1-103664,, Jun. 2010, 19 pages.
"Addition of PRS Muting Configuration Information to LPPa", 3GPP TSG RAN3 #68, Montreal, Canada; Ericsson, R3-101526, May 2010, 7 pages.
"Advisory Action", U.S. Appl. No. 12/650,699, Jan. 30, 2013, 3 pages.
"Advisory Action", U.S. Appl. No. 12/650,699, Sep. 25, 2014, 3 pages.
"Best Companion' reporting for improved single-cell MU-MIMO pairing", 3GPP TSG RAN WG1 #56; Athens, Greece; Alcatei-Lucent, R1-090926, Feb. 2009, 5 pages.
"Change Request—Clarification of the CP length of empty OFDM symbols in PRS subframes", 3GPP TSG RAN WG1 #59bis, Jeju, Vaiencia, Spain, ST-Ericsson, Motorola, Qualcomm Inc, R1-100311;, Jan. 2009, 2 pages.
"Change Request 36.211—Introduction of L TE Positioning", 3GPP TSG RAN WG1 #59, Jeju, South Korea; Ericsson, R1-095027, May 2010, 6 pages.
"Change Request 36.213 Clarification of POSCH and PRS in combination for L TE positioning", 3GPP TSG RAN WG1 #58bis, Miyazaki, Japan; Ericsson, et al., R1-094262;, Oct. 2009, 4 pages.
"Change Request 36.214—Introduction of LTE Positioning", 3GPP TSG RAN WG1 #59, Jeju, South Korea, Ericsson, et al., R1-094430, Nov. 2009, 4 pages.
"Companion Subset Based PMI/CQI Feedback for LTE-A MU-MIMO", 3GPP TSG RAN WG1 #60; San Francisco, USA, RIM; R1-101104, Feb. 2010, 8 pages.
"Comparison of PMI-based and SCF-based MU-MIMO", 3GPP TSG RAN1 #58; Shenzhen, China; R1-093421,, Aug. 2009, 5 pages.
"Development of two-stage feedback framework for Rel-10", 3GPP TSG RAN WG1 #60bis Meeting, R1-101859, Alcatel-Lucent Shanghai Bell, Alcatel-Lucent, Apr. 2010, 5 pages.
"Digital cellular telecommunications system (Phase 2+)", Location Services (LCS); Broadcast Network Assistance for Enhanced Observed Time Difference (E-OTD) and Global Positioning System (GPS) Positioning Methods (3GPP TS 04.35 version 8.3.0 Release 1999), 2001, 37 pages.
"Discussions on UE positioning issues", 3GPP TSG-RAN WG1 #57 R1-091911, San Francisco, USA,, May 2009, 12 pages.
"DL Codebook design for 8Tx preceding", 3GPP TSG RAN WG1 #60bis, R1-102380, LG Electronics, Beijing, China, Apr. 2010, 4 pages.
"Double codebook design principles", 3GPP TSG RAN WG1 #61bis, R1-103804, Nokia, Nokia Siemens Networks, Dresden, Germany, Jun. 2010, 9 pages.
"Evaluation of protocol architecture alternatives for positioning", 3GPP TSG-RAN WG2 #66bis R2-093855, Los Angeles, CA, USA, Jun. 2009, 4 pages.
"Ex Parte Quayle Action", U.S. Appl. No. 13/088,237, Dec. 19, 2012, 5 pages.
"Extended European Search Report", EP Application No. 12196319.3, Feb. 27, 2014, 7 pages.
"Extended European Search Report", EP Application No. 12196328.4, Feb. 26, 2014, 7 pages.
"Extensions to Rel-8 type CQI/PMI/RI feedback using double codebook structure", 3GPP TSG RAN WG1#59bis, R1-100251, Valencia, Spain,, Jan. 2010, 4 pages.
"Feedback Codebook Design and Performance Evaluation", 3GPP TSG RAN WG1 #61bis, R1-103970, LG Electronics, Jun. 2010, 6 pages.
"Feedback considerations for DL MIMO and CoMP", 3GPP TSG RAN WG1 #57bis; Los Angeles, USA; Qualcomm Europe; R1-092695, Jun. 2009, 6 pages.
"Final Office Action", U.S. Appl. No. 12/407,783, Feb. 15, 2012, 18 pages.
"Final Office Action", U.S. Appl. No. 12/573,456, Mar. 21, 2012, 12 pages.
"Final Office Action", U.S. Appl. No. 12/650,699, Jul. 16, 2014, 20 pages.
"Final Office Action", U.S. Appl. No. 12/650,699, Jul. 29, 2015, 26 pages.
"Final Office Action", U.S. Appl. No. 12/650,699, Nov. 13, 2012, 17 pages.
"Final Office Action", U.S. Appl. No. 12/756,777, Nov. 1, 2013, 12 pages.
"Final Office Action", U.S. Appl. No. 12/899,211, Oct. 24, 2013, 17 pages.
"Final Office Action", U.S. Appl. No. 13/477,609, Jul. 31, 2015, 11 pages.
"Final Office Action", U.S. Appl. No. 13/692,520, Apr. 2, 2015, 15 pages.
"Final Office Action", U.S. Appl. No. 13/721,771, Oct. 29, 2015, 8 pages.
"Final Office Action", U.S. Appl. No. 13/733,297, Jul. 22, 2015, 20 pages.
"Final Office Action", U.S. Appl. No. 13/873,557, Jul. 17, 2015, 13 pages.
"Final Office Action", U.S. Appl. No. 14/012,050, Jul. 6, 2015, 23 pages.
"Final Office Action", U.S. Appl. No. 14/052,903, Oct. 1, 2015, 10 pages.
"Final Office Action", U.S. Appl. No. 14/280,775, Dec. 9, 2015, 13 pages.
"Foreign Office Action", CN Application No. 201080025882.7, Feb. 8, 2014, 19 pages.

(56) References Cited

OTHER PUBLICATIONS

"Further details on DL OTDOA", 3GPP TSG RAN WG1 #56bis, Seoul, South Korea—Ericsson, R1-091312,, Mar. 2009, 6 pages.
"Further Refinements of Feedback Framework", 3GPP TSG-RAN WG1 #60bis R1-101742; Ericsson, ST-Ericsson, Apr. 2010, 8 pages.
"IEEE 802.16m System Description Document [Draft]", IEEE 802.16 Broadband Wireless Access Working Group, Nokia, Feb. 7, 2009, 171 pages.
"Implicit feedback in support of downlink MU-MIMO" Texas Instruments, 3GPP TSG RAN WG1 #58; Shenzhen, China, R1-093176, Aug. 2009, 4 pages.
"Improving the hearability of LTE Positioning Service", 3GPP TSG RAN WG1 #55bis; Alcatei-Lucent, R1-090053,, Jan. 2009, 5 pages.
"Innovator in Electronics, Technical Update, Filters & Modules PRM Alignment", Module Business Unit, Apr. 2011, 95 pages.
"International Preliminary Report on Patentability", Application No. PCT/US2013/042042, Mar. 10, 2015, 8 pages.
"International Search Report and Written Opinion", Application No. PCT/US2014/060440, Feb. 5, 2015, 11 pages.
"International Search Report and Written Opinion", Application No. PCT/US2014/045956, Oct. 31, 2014, 11 pages.
"International Search Report and Written Opinion", Application No: PCT/US2014/056642, Dec. 9, 2014, 11 pages.
"International Search Report and Written Opinion", Application No. PCT/US2013/071615, Mar. 5, 2014, 13 pages.
"International Search Report and Written Opinion", Application No. PCT/US2013/040242, Oct. 4, 2013, 14 pages.
"International Search Report and Written Opinion", Application No. PCT/US2014/047233, Jan. 22, 2015, 8 pages.
"International Search Report and Written Opinion", Application No. PCT/US2013/077919, Apr. 24, 2014, 8 pages.
"International Search Report and Written Opinion", Application No. PCT/US2014/070925, May 11, 2015, 9 pages.
"International Search Report and Written Opinion", Application No. PCT/US2014/018564, Jun. 18, 2014, 11 pages.
"International Search Report and Written Opinion", Application No. PCT/US2013/072718, Jun. 18, 2014, 12 pages.
"International Search Report and Written Opinion", Application No. PCT/US2015/027872, Jul. 15, 2015, 12 pages.
"International Search Report and Written Opinion", Application No. PCT/US2010/026579, Feb. 4, 2011, 13 pages.
"International Search Report and Written Opinion", Application No. PCT/US2011/034959, Aug. 16, 2011, 13 pages.
"International Search Report and Written Opinion", Application No. PCT/US2011/045209, Oct. 28, 2011, 14 pages.
"International Search Report and Written Opinion", Application No. PCT/US2011/039214, Sep. 14, 2011, 9 pages.
"International Search Report and Written Opinion", Application No. PCT/US2010/038257, Oct. 1, 2010, 9 pages.
"International Search Report and Written Opinion", Application No. PCT/US2010/034023, Dec. 1, 2010, 9 pages.
"International Search Report", Application No. PCT/US20013/071616, Mar. 5, 2014, 2 pages.
"International Search Report", Application No. PCT/US2010/030516, Oct. 8, 2010, 5 pages.
"International Search Report", Application No. PCT/US2010/036982, Nov. 22, 2010, 4 pages.
"International Search Report", Application No. PCT/US2010/041451, Oct. 25, 2010, 3 pages.
"International Search Report", Application No. PCT/US2011/044103, Oct. 24, 2011, 3 pages.
"International Search Report", Application No. PCT/US2014/014375, Apr. 7, 2014, 4 pages.
"Introduction of L TE Positioning", 3GPP TSG RAN WG1 #58, Shenzhen, China, R1-093604; Draft CR 36.213, Aug. 2009, 3 pages.
"Introduction of L TE Positioning", 3GPP TSG RAN WG1 #59, Jeju, South Korea, Ericsson et al.; R1-094429 Nov. 2009, 5 pages.
"Introduction of LTE Positioning", , 3GPP TSG RAN WG1 #58, Shenzhen, China; Draft CR 36.214; R1-093605;, Aug. 2009, 6 pages.
"Introduction of LTE Positioning", , 3GPP TSG-RAN WG1 Meeting #58, R1-093603, Shenzhen, China,, Aug. 2009, 5 pages.
"LS on 12 5. Assistance Information for OTDOA Positioning Support for L TE Rel-9", 3GPP TSG RAN WG1 Meeting #58; Shenzhen, China; R1-093729, Aug. 2009, 3 pages.
"LS on LTE measurement supporting Mobility", 3GPP TSG WG1 #48, Tdoc R1-071250; StLouis, USA, Feb. 2007, 2 pages.
"LTE Positioning Protocol (LPP)", 3GPP TS 36.355 V9.0.0 (Dec. 2009); 3rd Generation Partnership Project; Technical Specification Group Radio Access Network; Evolved Universal Terrestrial Radio Access (E-UTRA); Release 9, Dec. 2009, 102 pages.
"Market & Motivation (MRD Section3) for Interoperability Testing of Neighbor Awareness Networking", WiFi Alliance Neighbor Awareness Networking Marketing Task Group, Version 0.14, 2011, 18 pages.
"Marketing Statement of Work Neighbor Awareness Networking", Version 1.17, Neighbor Awareness Networking Task Group, May 2012, 18 pages.
"Method for Channel Quality Feedback in Wireless Communication Systems", U.S. Appl. No. 12/823,178, filed Jun. 25, 2010, 34 pages.
"Non-Final Office Action", U.S. Appl. No. 12/407,783, Sep. 9, 2013, 16 pages.
"Non-Final Office Action", U.S. Appl. No. 12/407,783, Oct. 5, 2011, 14 pages.
"Non-Final Office Action", U.S. Appl. No. 12/480,289, Jun. 9, 2011, 20 pages.
"Non-Final Office Action", U.S. Appl. No. 12/492,339, Aug. 19, 2011, 13 pages.
"Non-Final Office Action", U.S. Appl. No. 12/542,374, Feb. 24, 2014, 25 pages.
"Non-Final Office Action", U.S. Appl. No. 12/542,374, Aug. 7, 2013, 22 pages.
"Non-Final Office Action", U.S. Appl. No. 12/542,374, Aug. 31, 2012, 27 pages.
"Non-Final Office Action", U.S. Appl. No. 12/542,374, Dec. 23, 2011, 22 pages.
"Non-Final Office Action",U.S. Appl. No. 12/573,456, Nov. 18, 2011, 9 pages.
"Non-Final Office Action", U.S. Appl. No. 12/577,553, Feb. 4, 2014, 10 pages.
"Non-Final Office Action", U.S. Appl. No. 12/577,553, Aug. 12, 2013, 11 pages.
"Non-Final Office Action", U.S. Appl. No. 12/577,553, Dec. 28, 2011, 7 pages.
"Non-Final Office Action", U.S. Appl. No. 12/650,699, Mar. 30, 2015, 28 pages.
"Non-Final Office Action", U.S. Appl. No. 12/650,699, Apr. 23, 2013, 19 pages.
"Non-Final Office Action", U.S. Appl. No. 12/650,699, Jul. 19, 2012, 12 pages.
"Non-Final Office Action", U.S. Appl. No. 12/650,699, Dec. 16, 2013, 26 pages.
"Non-Final Office Action", U.S. Appl. No. 12/756,777, Apr. 19, 2013, 17 pages.
"Non-Final Office Action", U.S. Appl. No. 12/813,221, Oct. 8, 2013, 10 pages.
"Non-Final Office Action", U.S. Appl. No. 12/823,178, Aug. 23, 2012, 15 pages.
"Non-Final Office Action", U.S. Appl. No. 12/899,211, Apr. 10, 2014, 12 pages.
"Non-Final Office Action", U.S. Appl. No. 12/899,211, May 22, 2013, 17 pages.
"Non-Final Office Action", U.S. Appl. No. 12/973,467, Mar. 28, 2013, 9 pages.
"Non-Final Office Action", U.S. Appl. No. 13/477,609, Dec. 3, 2014, 7 pages.
"Non-Final Office Action", U.S. Appl. No. 13/477,609, Dec. 14, 2015, 9 pages.
"Non-Final Office Action", U.S. Appl. No. 13/692,520, Sep. 5, 2014, 15 pages.
"Non-Final Office Action", U.S. Appl. No. 13/692,520, Oct. 5, 2015, 17 pages.

(56) References Cited

OTHER PUBLICATIONS

"Non-Final Office Action", U.S. Appl. No. 13/721,771, May 20, 2015, 6 pages.
"Non-Final Office Action", U.S. Appl. No. 13/733,297, Mar. 13, 2015, 23 pages.
"Non-Final Office Action", U.S. Appl. No. 13/759,089, Apr. 18, 2013, 16 pages.
"Non-Final Office Action", U.S. Appl. No. 13/873,557, Mar. 11, 2015, 19 pages.
"Non-Final Office Action", U.S. Appl. No. 13/924,838, Nov. 28, 2014, 6 pages.
"Non-Final Office Action", U.S. Appl. No. 13/945,968, Apr. 28, 2015, 16 pages.
"Non-Final Office Action", U.S. Appl. No. 13/955,723, Dec. 17, 2015, 21 pages.
"Non-Final Office Action", U.S. Appl. No. 14/012,050, Feb. 10, 2015, 18 pages.
"Non-Final Office Action", U.S. Appl. No. 14/031,739, Aug. 18, 2015, 16 pages.
"Non-Final Office Action", U.S. Appl. No. 14/052,903, Mar. 11, 2015, 7 pages.
"Non-Final Office Action", U.S. Appl. No. 14/150,047, Jun. 29, 2015, 11 pages.
"Non-Final Office Action", U.S. Appl. No. 14/226,041, Jun. 5, 2015, 8 pages.
"Non-Final Office Action", U.S. Appl. No. 14/280,775, Jul. 16, 2015, 9 pages.
"Non-Final Office Action", U.S. Appl. No. 14/445,715, Jan. 15, 2016, 26 pages.
"Non-Final Office Action", U.S. Appl. No. 14/952,738, Jan. 11, 2016, 7 pages.
"Notice of Allowance", U.S. Appl. No. 12/365,166, Apr. 16, 2010, 7 pages.
"Notice of Allowance", U.S. Appl. No. 12/365,166, Aug. 25, 2010, 4 pages.
"Notice of Allowance", U.S. Appl. No. 12/650,699, Jan. 14, 2016, 8 pages.
"Notice of Allowance", U.S. Appl. No. 13/040,090, Mar. 8, 2012, 6 pages.
"Notice of Allowance", U.S. Appl. No. 13/088,237, Jun. 17, 2013, 8 pages.
"Notice of Allowance", U.S. Appl. No. 13/088,237, Jul. 11, 2013, 8 pages.
"Notice of Allowance", U.S. Appl. No. 13/188,419, May 22, 2013, 8 pages.
"Notice of Allowance", U.S. Appl. No. 13/873,557, Dec. 23, 2015, 10 pages.
"Notice of Allowance",U.S. Appl. No. 13/924,838, Mar. 12, 2015, 7 pages.
"Notice of Allowance", U.S. Appl. No. 13/924,838, Jul. 8, 2015, 7 pages.
"Notice of Allowance", U.S. Appl. No. 13/945,968, Sep. 16, 2015, 6 pages.
"Notice of Allowance", U.S. Appl. No. 14/012,050, Dec. 14, 2015, 12 pages.
"Notice of Allowance", U.S. Appl. No. 14/226,041, Dec. 31, 2015, 5 pages.
"Notice of Allowance", U.S. Appl. No. 14/488,709, Sep. 23, 2015, 10 pages.
"On Extensions to Rel-8 PMI Feedback", 3GPP TSG RAN WG1 #60, R1-101129, Motorola, San Francisco, USA,, Feb. 2010, 4 pages.
"On OTDOA in LTE", 3GPP TSG RAN WG1 #55bis, Ljubljana, Slovenia; R1-090353, Jan. 2009, 8 pages.
"On OTDOA method for L TE Positioning", 3GPP TSG RAN WG1 #56, Ericsson, R1-090918, Athens, Greece, Feb. 2009, 6 pages.
"On Serving Cell Muting for OTDOA Measurements", 3GPP TSG RAN1 #57, R1-092628—Los Angeles, CA, USA, Jun. 2009, 7 pages.
"Performance evaluation of adaptive codebook as enhancement of 4 Tx feedback", 3GPP TSG RAN WG1#61bis, R1-103447, Jul. 2010, 6 pages.
"PHY Layer 1 1 4. Specification Impact of Positioning Improvements", 3GPP TSG RAN WG1 #56bis, Athens, Greece; Qualcomm Europe, R1-090852,, Feb. 2009, 3 pages.
"Physical Channels and Modulation (Release 8)", 3GPP TS 36.211 V8.6.0 (Mar. 2009) 3rd Generation Partnership Project; Technical Specification Group Radio Access 28 Network; Evolved Universal Terrestrial Radio Access (E-UTRA);, Mar. 2009, 83 pages.
"Physical Channels and Modulation (Release 9)", 3GPP TS 36.211 V9.0.0 (Dec. 2009); 3rd Generation Partnership Project; Technical Specification Group Radio Access Network; Evolved Universal Terrestrial Radio Access (E-UTRA); Release 9, Dec. 2009, 85 pages.
"Physical layer procedures", 3GPP TS 36.213 V9.0.1 (Dec. 2009); 3rd Generation Partnership Project; Technical Specification Group Radio Access Network; Evolved Universal Terrestrial Radio Access (E-UTRA); Release 9, Dec. 2009, 79 pages.
"Positioning Subframe Muting for OTDOA Measurements", 3GPP TSG RAN1 #58 R1-093406, Shenzhen, P. R. China, Aug. 2009, 9 pages.
"Positioning Support for L TE", 3GPP TSG RAN WG1 #42, Athens, Greece, RP-080995, Dec. 2008, 5 pages.
"Pre-Brief Appeal Conference Decision", U.S. Appl. No. 12/650,699, Apr. 9, 2013, 2 pages.
"Rationale for mandating simulation of 4Tx Widely-Spaced Cross-Polarized Antenna Configuration for LTE-Advanced MU-MIMO", 3GPP TSG-RAN WG1 Meeting #61bis, R1-104184, Dresden, Germany, Jun. 2010, 5 pages.
"Reference Signals for Low Interference Subframes in Downlink;", 3GPP TSG RAN WG1 Meeting #56bis; Seoul, South Korea; Ericsson; R1-091314, Mar. 2009, 8 pages.
"Restriction Requirement", U.S. Appl. No. 13/721,771, Mar. 16, 2015, 5 pages.
"Restriction Requirement", U.S. Appl. No. 14/031,739, Apr. 28, 2015, 7 pages.
"Signaling Support for PRS Muting in", 3GPP TSG RAN2 #70, Montreal, Canada; Ericsson, ST-Ericsson; R2-103102, May 2010, 2 pages.
"Some Results on DL-MIMO Enhancements for LTE-A", 3GPP TSG WG1 #55bis, R1-090328, Motorola; Ljubjana, Slovenia, Jan. 2009, 5 pages.
"Sounding RS Control Signaling for Closed Loop Antenna Selection", 3GPP TSG RAN #51, R1-080017—Mitsubishi Electric, Jan. 2008, 8 pages.
"Study on hearability of reference signals in LTE positioning support", 3GPP TSG RAN1 #56bisa—R1-091336, Seoul, South Korea, Mar. 2009, 8 pages.
"Supplemental Notice of Allowance", U.S. Appl. No. 14/488,709, Oct. 7, 2015, 8 pages.
"System Simulation Results for OTDOA", 3GPP TSG RAN WG4 #53, Jeju, South Korea, Ericsson, R4-094532;, Nov. 2009, 3 pages.
"Technical 1 34. Specification Group Radio Access Network; Evolved Universal Terrestrial Radio Access (E-UTRA);", 3GPP TS 36.211 v8.4.0 (Sep. 2008); 3rd Generation Partnership Project; Physical Channels and Modulation (Release 8), 2008, 78 pages.
"Technical Specification Group Radio Access Network", 3GPP TS 25.305 V8.1.0 (Dec. 2008) 3rd Generation Partnership Project; Stage 2 functional specification of User Equipment (UE) positioning in UTRAN (Release 8), 2008, 79 pages.
"Technical Specification Group Radio Access Network; Evolved Universal Terrestrial Radio Access (E-UTRA)", 3GPP TS 36.305 V0.2.0 (May 2009) 3rd generation Partnership Project; Stage 2 functional specification of User Equipment, (UE) positioning in E-UTRAN (Release 9);, 2010, 52 pages.
"Text 1 3 0. proposal on Orthonogonal PRS transmissions in mixed CP deployments using MBSFN subframes", 3GPP TSG RAN WG1 #59, Jeju, South Korea, Motorola, R1-095003;, Nov. 2009, 4 pages.
"Text proposal on measurements", 3GPP TSG RAN2 #60bis, Tdoc R2-080420; Motorola, Sevilla, Spain, Jan. 2008, 9 pages.

(56) References Cited

OTHER PUBLICATIONS

"Two Component Feedback Design and Codebooks", 3GPP TSG RAN1 #61, R1-103328, Motorola, Montreal, Canada, May 2010, 7 pages.
"Two-Level Codebook design for MU MIMO enhancement", 3GPP TSG RAN WG1 #60, R1-102904, Montreal, Canada, May 2010, 8 pages.
"UTRAN SFN-SFN observed lime 11 difference measurement & 3GPP TS 25.311 IE 10.3.7.106 UE positioning OTDOA neighbor cell info' assistance data D fields", 3GPP TSG RAN WG4 (Radio) #20, New Jersey, USA; Tdoc R4-011408,, Nov. 2001, 4 pages.
"View on the feedback framework for Rei. 1 0", 3GPP TSG RAN WG1 #61, R1-103026, Samsung, Montreal, Canada, May 2010, 15 pages.
"Views on Codebook Design for Downlink 8Tx MIMO", 3GPP TSG RAN WG1 #60. R1-101219, San Francisco, USA, Feb. 2010, 9 pages.
Colin,"Restrictions on Autonomous Muting to Enable 1 58. Time Difference of Arrival Measurements", U.S. Appl. No. 61/295,678, filed Jan. 15, 2010, 26 pages.
Costas,"A Study of a Class of Detection Waveforms Having Nearly Ideal Range-Doppler Ambiguity Properties", Fellow, IEEE; Proceedings of the IEEE, vol. 72, No. 8, Aug. 1984, 14 pages.
Guo,"A Series-Shunt Symmetric Swtich Makes Transmit-Receive Antennas Reconfigurable in Multipath Channels", IEEE 3d Int'l Conf. on Digital Object Identifier, May 29, 2011, pp. 468-471.
Jafar,"On Optimality of Beamforming for Multiple Antenna Systems with Imperfect Feedback", Department of Electrical Engineering, Stanford University, CA, USA, 2004, 7 pages.
Knoppert,"Communication Device", U.S. Appl. No. 29/329,028, filed Dec. 8, 2008, 10 pages.
Knoppert,"Indicator Shelf for Portable Electronic Device", U.S. Appl. No. 12/480,289, filed Jun. 8, 2009, 15 pages.
Krishnamurthy,"Interference Control, SINR Optimization and Signaling Enhancements to Improve the Performance of OTDOA Measurements", U.S. Appl. No. 12/813,221, filed Jun. 10, 2010, 20 pages.
Krishnamurthy,"Threshold Determination in TDOA-Based Positioning System", U.S. Appl. No. 12/712,191, filed Feb. 24, 2010, 19 pages.
Li,"A Subband Feedback Controlled Generalized Sidelobe Canceller in Frequency Domain with Multi-Channel Postfilter", 2nd International Workshop on Intelligent Systems and Applications (ISA), IEEE, May 22, 2010, 4 pages.
MACCM"GaAs SP6T 2.5V High Power Switch Dual-/Tri-/Quad-Band GSM Applications", Rev. V1 data sheet, www.macomtech.com, Mar. 22, 2003, 5 pages.
Renesas,"uPG2417T6M GaAs Integrated Circuit SP6T Switch for NFC Application (RO9DS0010EJ0100)", Rev. 1.00 data sheet, Dec. 24, 2010, 12 pages.
Sayana,"Method of Codebook Design and Precoder Feedback in Wireless Communication Systems", U.S. Appl. No. 61/374,241, filed Aug. 16, 2010, 40 pages.
Sayana,"Method of Precoder Information Feedback in Multi-Antenna Wireless Communication Systems", U.S. Appl. No. 61/331,818, filed May 5, 2010, 43 pages.
Tesoriero,"Improving Location Awareness in Indoor Spaces Using RFID Technology", ScienceDirect, Expert Systems with Applications, 2010, 894-898.
Valkonen,"Impedance Matching and Tuning of Non-Resonant Mobile Terminal Antennas", Aalto University Doctoral Dissertations, Mar. 15, 2013, 94 pages.
Visotsky,"Space—Time Transmit Precoding With Imperfect Feedback", IEEE Transactions on Information Theory, vol. 47, No. 6, Sep. 2001, pp. 2632-2639.
Vodafone"PDCCH Structure for MTC Enhanced Coverage", 3GPP TSG RAN WG1 #76, R1-141030, Prague, Czech Republic, Feb. 2014, 2 pages.
Yun,"Distributed Self-Pruning(DSP) Algorithm for Bridges in Clustered Ad Hoc Networks", Embedded Software and Systems; Lecture Notes in Computer Science, Springer, May 14, 2007, pp. 699-707.
Zhuang,"Method for Precoding Based on Antenna Grouping", U.S. Appl. No. 12/899,211, filed Oct. 6, 2010, 26 pages.
"Final Office Action", U.S. Appl. No. 14/150,047, Mar. 4, 2016, 14 pages.
"Non-Final Office Action", U.S. Appl. No. 13/733,297, Feb. 2, 2016, 17 pages.
"Non-Final Office Action", U.S. Appl. No. 14/280,775, Mar. 23, 2016, 11 pages.
"Non-Final Office Action", U.S. Appl. No. 14/330,317, Feb. 25, 2016, 14 pages.
"Notice of Allowance",U.S. Appl. No. 13/873,557, Apr. 11, 2016, 5 pages.
"Notice of Allowance", U.S. Appl. No. 14/031,739, Mar. 1, 2016, 7 pages.
"Notice of Allowance", U.S. Appl. No. 14/052,903, Feb. 1, 2016, 8 pages.
"Notice of Allowance", U.S. Appl. No. 14/952,738, Mar. 28, 2016, 7 pages.
Foreign Office Action, CN Application No. 201480013330.2, Jun. 2, 2016, 15 pages.
Final Office Action, U.S. Appl. No. 13/733,297, Jul. 18, 2016, 17 pages.
Final Office Action, U.S. Appl. No. 14/445,715, Jul. 8, 2016, 31 pages.
Notice of Allowance, U.S. Appl. No. 14/280,755, Jul. 15, 2016, 5 pages.
Advisory Action, U.S. Appl. No. 13/692,520, Sep. 6, 2016, 3 pages.

* cited by examiner

ANTENNA SYSTEM AND METHOD OF ASSEMBLY FOR A WEARABLE ELECTRONIC DEVICE

RELATED APPLICATIONS

The present application is related to and claims benefit under 35 U.S.C. §119(e) from U.S. Provisional Patent Application Ser. Nos. 62/006,316 filed Jun. 2, 2014 and 62/016,884 filed Jun. 25, 2014, the entire contents of each being incorporated herein by reference.

FIELD OF THE DISCLOSURE

The present disclosure relates to an antenna system for a wearable electronic device and more particularly to an antenna system constructed from an outer housing of the wearable electronic device.

BACKGROUND

As electronics evolve, items that are commonly worn on a person's body are adapted to perform additional functions. For example, some wristwatches and eyeglasses are fitted with electronics to perform functions such as visual recordings and wireless transmission. One shortcoming, however, in such devices is a tradeoff between stylish appearance and electronic performance. More particularly, for some electronics, high performance is achieved at the expense of concessions in appearance, and an elegant appearance is achieved by compromising performance.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

Figure 1:
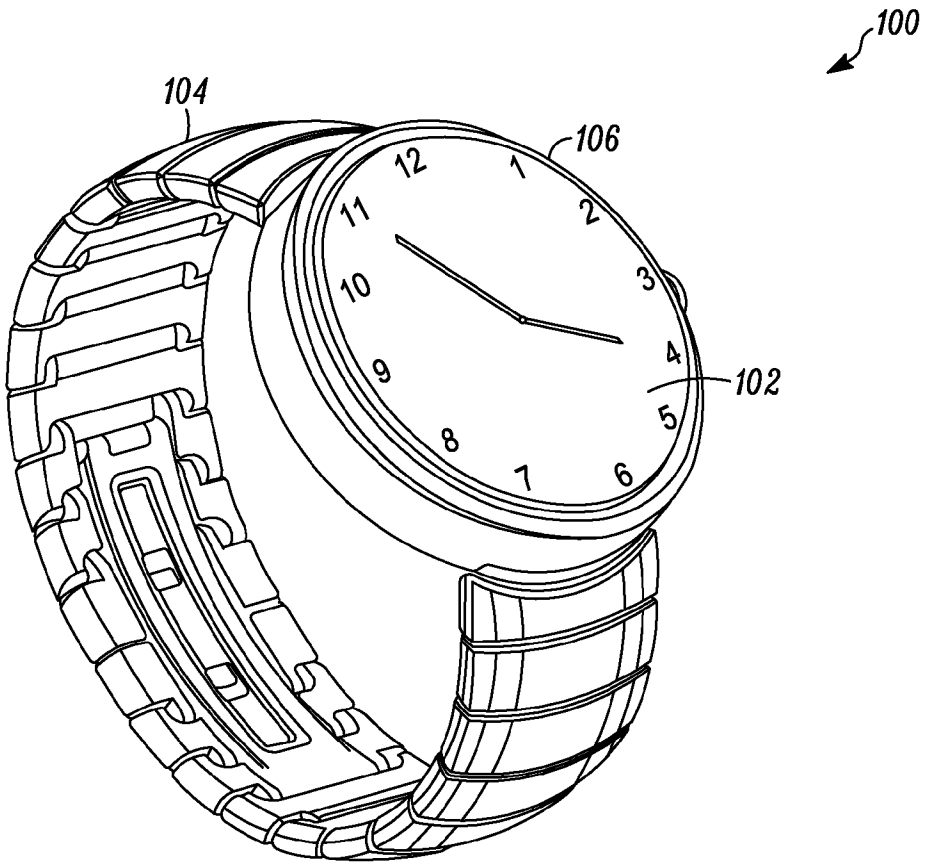
FIG. 1 is a diagram illustrating a wearable electronic device configured with an antenna system in accordance with an embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure. In addition, the description and drawings do not necessarily require the order illustrated. It will be further appreciated that certain actions and/or steps may be described or depicted in a particular order of occurrence while those skilled in the art will understand that such specificity with respect to sequence is not actually required.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Generally speaking, pursuant to the various embodiments, the present disclosure provides for an antenna system for a wearable electronic device. In one example embodiment, the antenna system includes a first conductive surface constructed from a segment of outer housing of the wearable electronic device. The first conductive surface spans a first axis through the wearable electronic device. The antenna system also includes a second conductive surface that spans the first axis. The second conductive surface is constructed from a set of contacting metal components that are internal to the wearable electronic device. The first and second conductive surfaces are separated by a space. In one example embodiment, the antenna system also includes a contact element having a feeding element that connects the first conductive surface to the second conductive surface along a plane that is normal to the first conductive surface.

In another implementation, a wearable electronic device includes a rear housing component and a front housing component. The front housing component is connected to the rear housing component at a first edge, and the front housing component has an opening at a second opposing edge. The wearable electronic device also includes internal components at least partially enclosed by the front and rear housing components. The internal components include a display having a surface that spans the opening of the front housing component. The wearable electronic device further includes an antenna system in accordance with an embodiment. The antenna system has a first conductive surface constructed from a segment of the front housing component. The first conductive surface is disposed normal to the surface of the display. The antenna system also includes a second conductive surface disposed normal to the surface of the display. The second conductive surface is constructed from a set of contacting metal components of the internal components. The first and second conductive surfaces are separated by a space. The antenna system further includes a contact element having a feeding element that connects the first conductive surface to the second conductive surface along a direction that is normal to the first conductive surface.

In accordance with yet another embodiment is a method for assembling a wearable electronic device having a slot antenna. The method includes layering a contact element, a printed circuit board, and a display onto at least one of a rear housing component or a front housing component. The layering is performed along a first axis. The method further includes connecting the front housing component to the rear housing component to assemble the wearable electronic device such that a lateral surface of the front housing component extends along the first axis, wherein the connecting creates a slot antenna. The created slot antenna includes first and second conductive surfaces disposed along the first axis and separated by a space and further includes the contact element. The first conductive surface is constructed from a segment of the lateral surface of the front housing component. The second conductive surface is constructed from a segment of the printed circuit board and a segment of at least one metal element disposed between the printed circuit board and the display. A feeding element of the contact element connects the first conductive surface to the segment of the printed circuit board along a direction that is normal to the first conductive surface.

Turning to the drawings, FIG. 1 illustrates a representative wearable electronic device 100 in which embodiments of an antenna system can be implemented. The wearable electronic device 100 includes a portable electronic device 106, in this case a smartwatch, having a display assembly 102. The wearable electronic device 100 further includes a wearable element 104 attached to the portable electronic device 106, in this case a wristband 104, which allows the portable electronic device 106 to be worn on a person's body. The present disclosure refers to a smartwatch or wrist-worn electronic device to illustrate embodiments of the antenna system. However, the antenna system and method for assembling a wearable electronic device that includes the antenna system, described herein, can be applied to any electronic device that can operate using an antenna. Such devices include, but are not limited to: other types of wearable electronic devices such as eyewear that incorporates a portable electronic device; portable electronic devices for monitoring body functions such as heart rate monitors and pulse monitors; and the like.

In the example smartwatch 100 of FIG. 1, the display assembly 102 is circular and can display information such as the current date and time, notifications, images, and the like. In the embodiment shown, the display assembly 102 is implemented as an analog watch-face that displays the current time using multiple rotating hour and minute pointers or hands that point to numbers arranged around a circumference of the display assembly 102. In other embodiments, the watch-face digitally displays information such as the current date and time as a sequence of alpha-numeric digits. In further embodiments, the display assembly 102 hosts a user interface through which the smartwatch 100 can be configured and controlled. In yet other embodiments, the display assembly 102 has another shape, such as square, rectangular, oval, etc.

Figure 2:
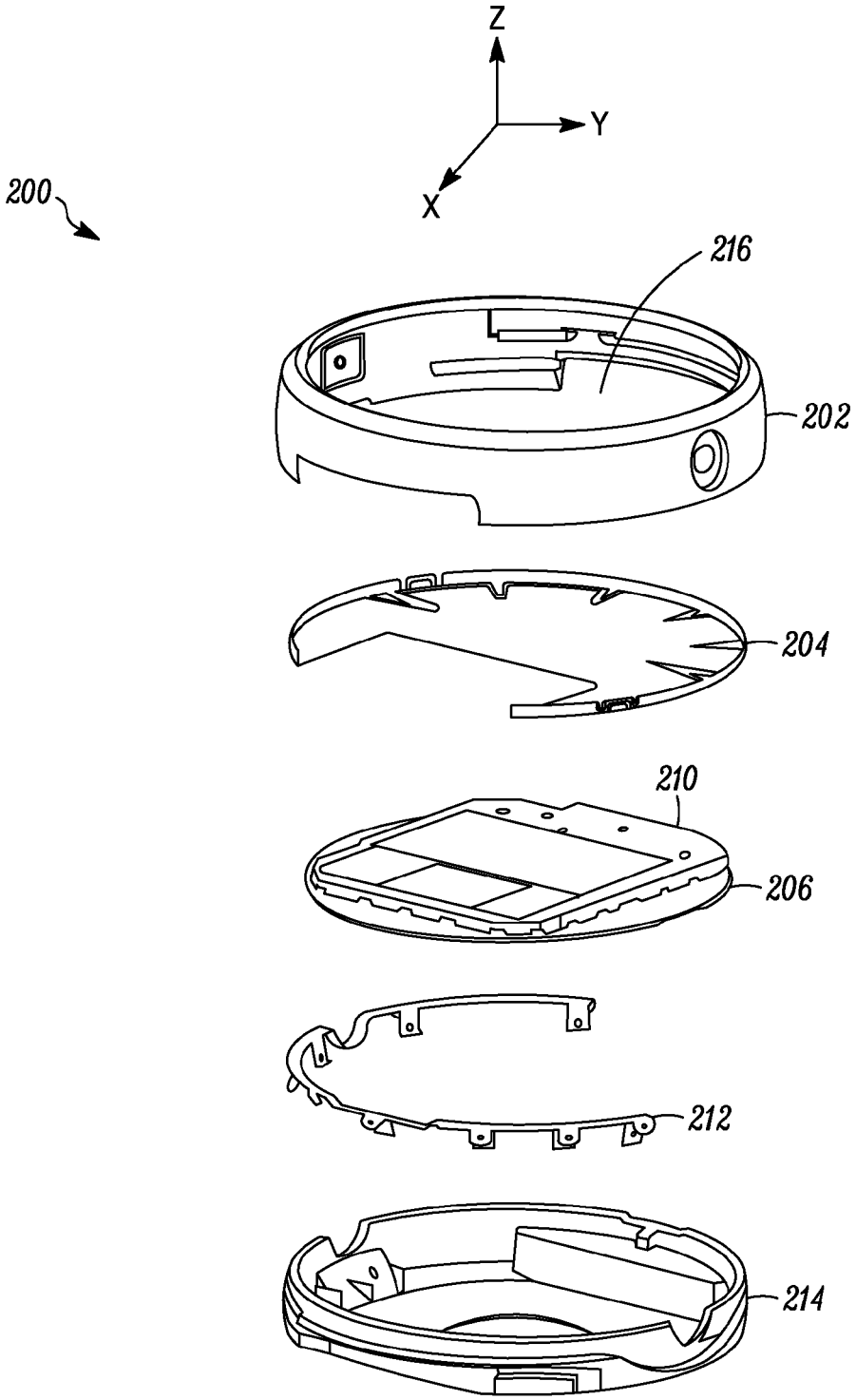
FIG. 2 illustrates an exploded view of various components of a wearable electronic device configured with an antenna system in accordance with an embodiment.

FIGS. 2-8 illustrate different views of an electronic device, such as the smartwatch 100, that incorporates the present teachings. Therefore, when describing FIGS. 2-8, reference will be made specifically to the smartwatch 100 shown in FIG. 1, although the principles described can be applied to other types of electronic devices. In FIG. 2 some components 200 the smartwatch 100 are shown in an exploded view. Illustratively, the smartwatch 100 incorporates the components 200 in a "stack," wherein a plurality of internal components including a display bezel 204, a printed circuit board (PCB) 206, a shield 210, and a contact element 212 are stacked or layered on top of one another and enclosed within a cavity of front 202 and rear 214 outer housing components. Front and rear housing components are also referred to herein as front and rear housing. As shown, the components 202, 204, 206, 210, 212, and 214 are stacked along a Z axis, which is also referred to herein and in the claims as a first axis. FIG. 2 shows one illustrative layering or stacking of the components 200 of the smartwatch 100. In other embodiments, however: some of the components 200 are disposed in different locations of the stack; major components are combined into a unitary component; and other components, not shown in FIG. 2, are included to accomplish specific tasks.

Further to the details of the illustrative component stack 200, the front housing component 202 has a cylindrical shape with a cavity in the center that is sufficiently deep to enclose or contain most or all of the internal components of the device 100. The front housing component 202 is constructed from a conductive material, such as any suitable metal, to enable a segment of the front housing component 202 to form part of an antenna system or antenna for short, in accordance with the present disclosure, for the smartwatch 100. Namely, a first conductive surface of the antenna is constructed from a portion of the front housing component 202.

The display bezel 204 is disposed between a display assembly (not shown in FIG. 2) and the PCB 206, and provides support for the display assembly after the device 100 is assembled. Also, when assembled, a lens or touchscreen of the display assembly extends through an opening 216 of the front housing component 202. An example display assembly includes a number of layers that are adhesively attached to the front housing 202. For example, layers of a liquid crystal display (LCD) assembly include, but are not limited to, polarizing films, glass substrates, and an LCD panel. Resistive touchscreens include, for instance, multiple electrically resistive layers. Capacitive touchscreens include multiple layers assembled to detect a capacitive impingement on the touchscreen.

Electronic components on the PCB 206 provide most of the intelligent functionality of the device 100. The PCB 206 illustratively includes electronic components, such as, one or more communication elements, e.g., transceivers, that enable wireless transmission and reception of data. One example PCB 206 also includes media-capture components, such as an integrated microphone to capture audio and a camera to capture still images or video media content. Various sensors, such as a PhotoPlethysmoGraphic sensor for measuring blood pressure, are disposed on some PCBs 206. Still other PCBs 206 have processors, for example one or a combination of microprocessors, controllers, and the like, which process computer-executable instructions to control operation of the smartwatch 100. In still other examples, the PCB 206 includes memory components and audio and video processing systems. In this example component stack, the shield 210 is positioned over the PCB 206 to protect the electronic components arranged on the PCB 206.

The contact element 212 is another component of the antenna system, for the electronic device 100, in accordance with the present teachings. For some embodiments, the antenna system is arranged as a slot antenna, wherein the contact element 212 connects the first conductive surface of the antenna (that functions as a radiator) with a second conductive surface of the antenna (that functions as electrical ground), to drive the antenna. Further, the contact element 212 tunes the antenna based on how the contact element 212 is configured. An example contact element 212 is constructed from a conductive material, e.g., any suitable metal.

In an embodiment, the contact element 212 is configured to electrically connect the front housing 202, from which the first conductive surface of the antenna is constructed, to the printed circuit board 206, which is one contacting metal component of a second conductive surface of the antenna system for the device 100. In a particular embodiment, the display bezel 204 and the shield 210 are also contacting metal components that make up the second conductive surface. "Contacting" metal components or elements are internal components of a device that are physically connected or physically touch at some metal segment of the components to provide a continuous electrical connection along multiple conductive surfaces, for instance to provide an electrical ground for a slot antenna. A contacting metal component need not be constructed entirely of metal. Only the segment of the contacting metal component that makes up part of the second conductive surface needs to be constructed of metal.

The rear housing component 214 is made of any suitable non-conductive or non-metallic material, with ceramic used in some embodiments and plastic used in other embodiments. Using a non-metallic material for the rear housing 214 prevents inadvertent electrical connections between the first and second conductive surfaces of the antenna, which would negatively impact the antenna's functionality. In one particular embodiment, the wristband 104 (see FIG. 1) or other wearable element attaches to the rear housing 214 with wristband-attachment pins (not shown) or via another well known mechanism. Housing-attachment pins (not shown) are one possible mechanism for connecting the rear housing 214 to the front housing 202. In a further embodiment, a separate endplate (not shown) covers the rear housing 214.

As mentioned above, in one example, the device 100 includes an antenna system that can be configured to operate as or in accordance with principles of operation of a slot antenna. Namely, conventional slot antennas are constructed by creating a narrow slot or opening in a single metal surface and driving the metal surface by a driving frequency such that the slot radiates electromagnetic waves. For some implementations, the slot length is in the range of a half wavelength at the driving frequency.

By contrast, instead of an opening being cut into a single metal surface to create the slot antenna, the present teachings describe a space, gap or aperture (the effective "slot") located between first and second conductive surfaces of an antenna system, wherein the antenna system can be configured to radiate electromagnetic waves at a desired frequency through this slot, also referred to herein as a radiating slot. In essence, an antenna system in accordance with the present teachings can be termed as a "slot" antenna since it can be configured to radiate, through the space or slot between the first and second conductive surfaces, electromagnetic waves having a substantially similar pattern to the electromagnetic waves radiated through the opening of a conventional slot antenna. More particularly, in accordance with an embodiment, the antenna system can be configured with an aperture between the first and second conductive surfaces that has a length that is in the range of a half wavelength at the driving frequency.

Figure 3:
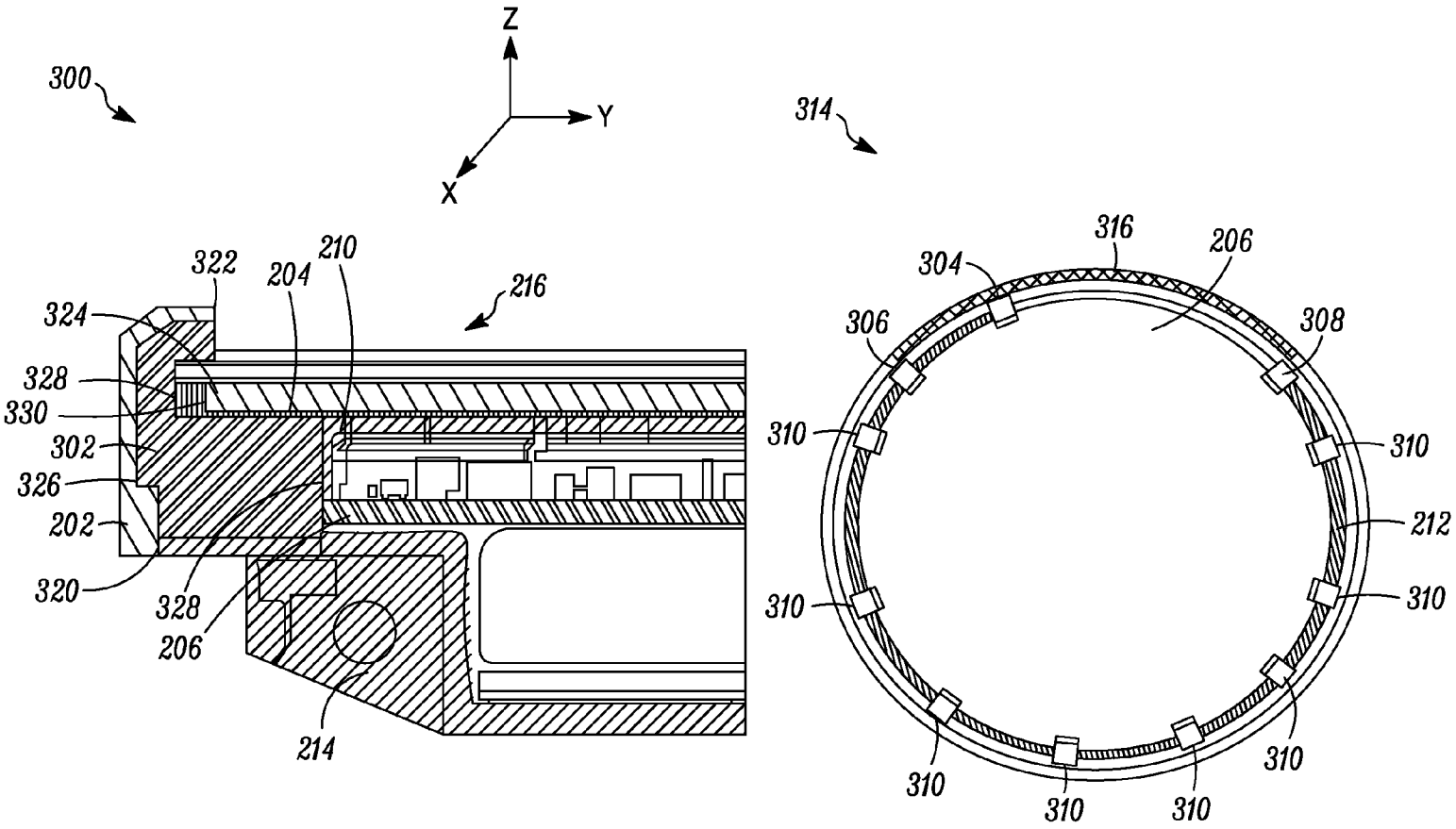
FIG. 3 illustrates a cross-sectional view and a plan view of components of a wearable electronic device configured with an antenna system in accordance with an embodiment.

FIG. 3 shows a cross-sectional view 300 of the components 202, 204, 210, 206, and 214 when the smartwatch 100 is assembled. More specifically, when assembled, the front housing component 202 is connected to the rear housing component 214 at a first edge 320 of the front housing component 202. The front 202 and rear 214 housing components may also be connected at areas other than the edge 320. The opening 216 of the front housing component 202 is at a second opposing edge 322 of the front housing component 202. The front and rear housing components 202, 214 at least partially enclose the internal components, e.g., 204, 206, 210, and 212, of the device 100.

The internal components also include a display 324 that spans the opening 216 of the front housing component 202. As used herein, a "display" of a display assembly is the element or panel, for instance an LCD panel or capacitive element panel, upon which pixels of an image or picture, video, or other data are shown. Properties of the display 324 are described in greater detail in relation to FIG. 7. A surface spans an axis or opening when the surface extends over or across the axis or opening in the same direction of the axis or opening. A first surface spans a second surface when the first surface extends at least partially over or across the second surface in the same direction as the second surface, wherein there is at least some overlap between the two surfaces. It should be noted that for one surface to span another surface, the two surfaces need not be directly adjacent to one another. Similarly, for a surface to span an opening, the surface need not be directly adjacent to the opening.

Illustratively, an edge 330 of the surface of the display 324 aligns with the second edge 322 of the front housing component 202. Thus, the display 324 spans the opening 216 such that there is no mask positioned between edges of the display 324 and the second opposing edge 322 of the front housing component 202. Accordingly, when a user views the electronic device 100 from above, the display 324 can be configured to display images in a region that spans the full area of the opening 216, which beneficially provides for a device that has an edge-to-edge display.

The cross-sectional view 300 further illustrates an antenna system, in accordance with the present teachings, having first 326 and second 328 conductive surfaces that are separated by a space 302 that can radiate electromagnetic waves as a slot antenna. In this example, the first conductive surface 326 is constructed from a segment of outer housing of the wrist-worn electronic device 100. In a particular embodiment, the first conductive surface 326 for the antenna system is formed using an inner surface of the front housing component 202. In this case, the front housing component 202 has a cylindrical shape such that the segment of the outer housing from which the first conductive surface 326 is constructed is curved. Where the outer housing has a different shape, such as cuboid, the segment of the outer housing from which the first conductive surface 326 is constructed can have right angles.

Illustratively, the first conductive surface 326 is also seamless, meaning that the first conductive surface is a continuous piece of metal in an area where currents flow when the antenna system is operating, notwithstanding the continuous piece having openings for buttons and such. This seamlessness enables the current generated during the operation of the antenna system to be maintained within the inner surface of the front housing component 202, as opposed to escaping through a discontinuity in the housing component. This allows more efficient operation of the antenna system. As further illustrated in the cross-sectional view 300, the first conductive surface 326 spans a first axis, which in this case is the Z axis, through the electronic device 100. In relation to the display 324, which has a surface that spans the X and Y axes, the first conductive surface 326 is disposed normal to the surface of the display 324.

Also illustrated in cross-sectional view 300, the second conductive surface 328 is constructed from a set of contacting metal components that are internal to the electronic device. As used herein, a set includes one or more of a particular item. As mentioned above, in this case, the second conductive surface 328 is constructed from the set of contacting metal components which includes the internal components of the PCB 206, the shield 210, and the display bezel 204. In this embodiment, the second conductive surface 328 is constructed from adjacent contacting metal surfaces of each of the internal components 204, 206, and 210.

Particularly, the PCB 206 is disposed adjacent to, in this case directly adjacent to, the rear housing component 214. The shield 210 is disposed directly adjacent to the PCB 206. The display bezel 204 is disposed directly adjacent to the shield 210 and the display 324. Two items that are adjacent to each other are near or in the vicinity or proximity of each other. Directly adjacent items contact one another in at least one location. Accordingly, the second conductive surface 328 that is formed from the contacting metal segments of the adjacent internal components 204, 206, and 210 is also disposed along the Z axis normal to the surface of the display 324.

A properly performing antenna radiates, meaning communicates by sending and/receiving, radio waves (also referred to herein as signals) in a desired frequency range, referred to herein as the desired radiating frequency or the radiating frequency of the antenna, using a radiating structure that is driven by at least one feeding element. The antenna further suppresses one or more undesired or unwanted radiating frequencies, referred to herein as frequencies outside the desired radiating frequency, using at least one suppression element. In some embodiments, the contact element 212 is configured to perform the functions of setting and feeding the desired radiating frequency and suppressing unwanted frequencies.

FIG. 3 illustrates an overhead view 314 of the device 100 showing an example contact element 212 in accordance with the present teachings. The view 314 omits many of the components of the device 100 shown in the cross-sectional view 300 to focus on the contact element 212 in the context of the device 100 as a whole. As shown, the contact element 212 includes a plurality of legs 304, 306, 308, and 310, which are also referred to herein as extensions. In some embodiments, the extensions 304, 306, 308, and 310 connect the first electrical conductor 326 to the second electrical conductor 328 at different location along the PCB 206 and the front housing component 202. Moreover, the extensions 304, 306, 308, and 310 have a substantially similar construction, but perform different functions. Namely, the extension 304 operates as a feeding element; the extensions 306 and 308 operate as frequency setting elements, and the extensions 310 operate as frequency suppression elements, as explained in further detail below. Further, the extensions 304, 306, 308, and 310 define physical characteristics of an antenna system for the device 100, in accordance with the present teachings.

For one embodiment, the extensions 304, 306, 308, and 310 define physical characteristics of a slot antenna having a radiating slot 316 formed between the first 326 and second 328 conductive surfaces. During operation, the antenna system radiates electromagnetic waves through the radiating slot 316 at the desired radiating frequency. The length of the radiating slot 316 affects the radiating frequency at which the antenna operates and is defined by the position of the legs 306 and 308. Particularly, the leg 306 is located coincident with a first end of the radiating slot 316, and the leg 308 is located coincident with a second end of the radiating slot 316. Accordingly, the legs 306 and 308 operate as first and second frequency setting elements the locations of which control the radiating frequency for the slot antenna having the slot 316.

In other examples, the frequency setting elements 306 and 308 are located closer or further apart, which changes the length of the slot 316, thereby, changing the radiating frequency of the slot antenna. The feeding element 304 is illustratively located between the first and second legs 306 and 308 and functions to drive the first conductive surface 326, which operates as a radiating structure, to generate and radiate radio waves at the desired radiating frequency through the slot 316.

Similar to some other antenna structures, an antenna in accordance with the present teachings operates in a particular frequency range. If the antenna emanates signals outside of this frequency range, the effectiveness of the antenna is compromised. Thus, such undesired frequencies should be suppressed. Accordingly, in an embodiment, the contact element 212 includes the set of frequency suppression elements 310, which operate to suppress one or more undesired radiating frequencies. Particularly, the frequency suppression elements 310 minimize the space between the first 326 and second 328 conductive surfaces in circumferential areas of the device 100 other than the slot 316 to, thereby, minimize the radiation of frequencies that are not within the range of operating frequencies for the antenna. Although in this embodiment eight frequency suppression elements 310 are shown, in other embodiments the device 100 includes more or fewer frequency suppression elements 310. Further, locations of the frequency suppression elements 310 may vary relative to one another in different embodiments depending on which frequencies are to be suppressed.

Figure 4:
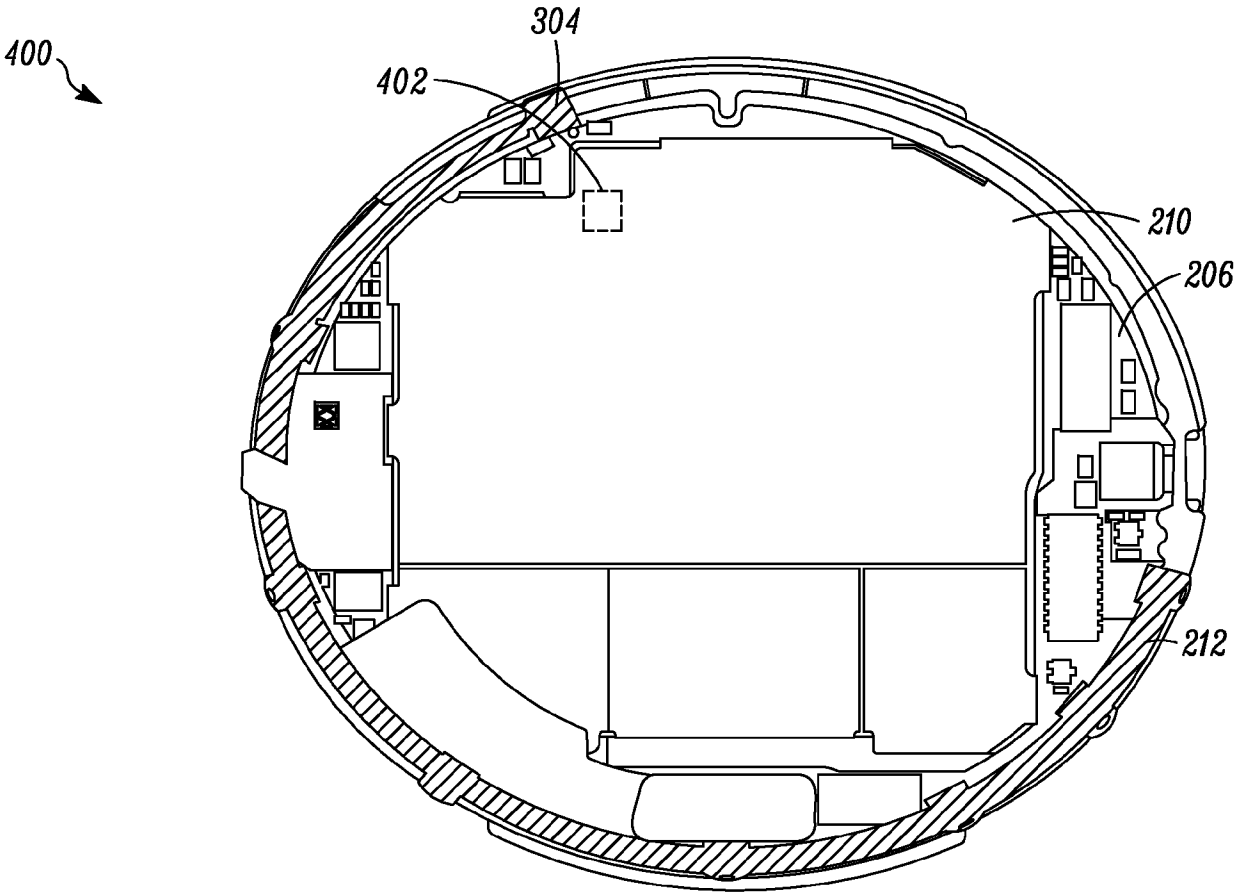
FIG. 4 illustrates another plan view of components of a wearable electronic device configured with an antenna system in accordance with an embodiment.

FIG. 4 illustrates a plan view 400 of the device 100 looking down through the opening 216 of the outer housing 202. The view 400 shows the contact element 212, the PCB 206 with various electronic components arranged thereon, and the shield 210. In one example, the components arranged on the PCB 206 include a wireless transceiver 402 disposed near the feeding element 304. The wireless transceiver 402 communicates device data using the feeding element 304. Namely, the feeding element 304 is electrically connected to the wireless transceiver 402, for instance using metal traces that are not shown. The feeding element 304 also connects to the first conductive surface 326, which is constructed from the outer housing 302. The first conductive surface 326 operates as a radiating element to communicate wireless signals carrying device data between the wireless transceiver 402 and wireless transceivers of external devices.

The wireless transceiver 402 is configured with hardware capable of wireless reception and transmission using at least one standard or proprietary wireless protocol. Such wireless communication protocols include, but are not limited to: various wireless personal-area-network standards, such as Institute of Electrical and Electronics Engineers ("IEEE") 802.15 standards, Infrared Data Association standards, or wireless Universal Serial Bus standards, to name just a few; wireless local-area-network standards including any of the various IEEE 802.11 standards; wireless-wide-area-network standards for cellular telephony; wireless-metropolitan-area-network standards including various IEEE 802.15 standards; Bluetooth or other short-range wireless technologies; etc.

Figure 5:
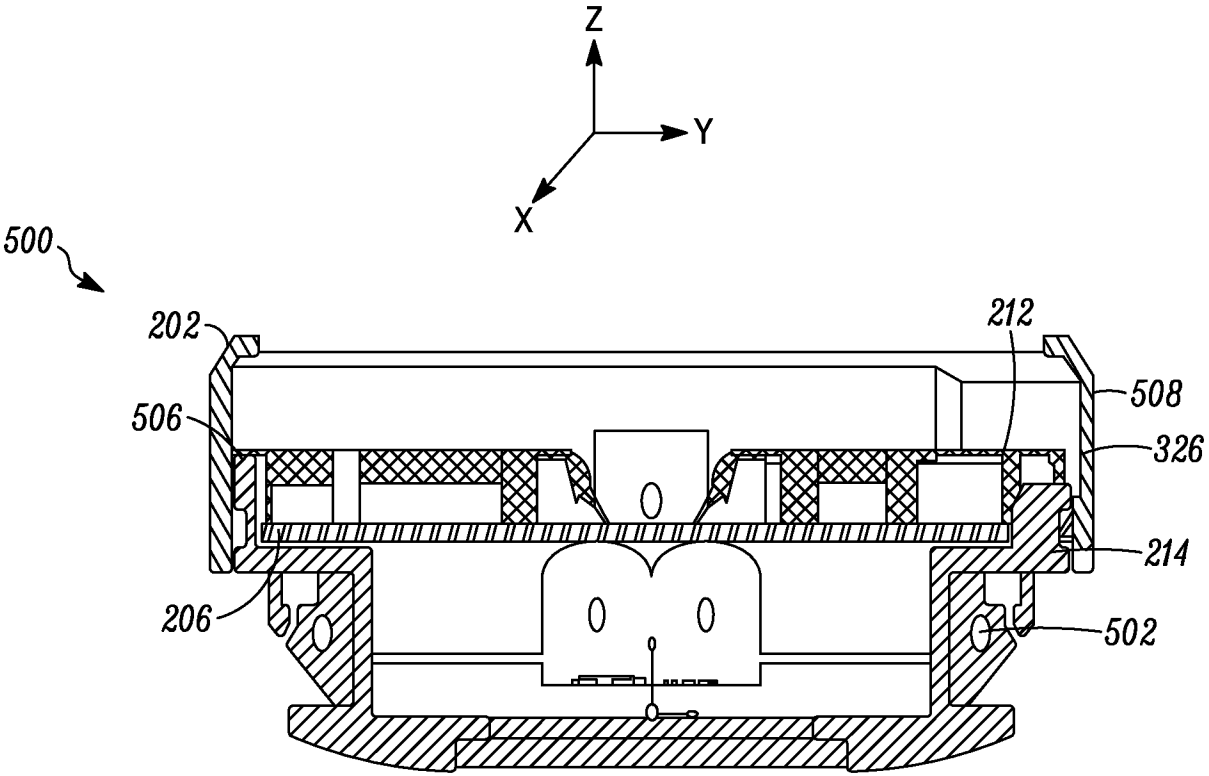
FIG. 5 illustrates another cross-sectional view of components of a wearable electronic device configured with an antenna system in accordance with an embodiment.

Turning now to FIG. 5, which illustrates a cross-sectional view 500 of the device. During assembly of the device 100, the front housing 202 is engaged with the rear housing component 214 by applying forces along the Z axis which is substantially normal to a top surface of the PCB 206, which spans the X and Y axes. The cross-sectional view 500 also illustrates that, in one example, the contact element 212 is disposed on an upper surface 506 of the rear housing component 214.

View 500 further shows that the first conductive surface 326 extends down to the rear housing component 214. Consequently, some embodiments of the electronic device can include a metal component, such as wristband 104, connected to an outside surface 508 of the front housing component proximal to the first conductive surface 326. The metal component can further be proximal to a region, within the space between the first and second conductive surfaces, which contains current when the antenna system is operating without affecting the antenna's transmission properties as long as the metal component is not positioned such as to electrically short together the first and second conductive surfaces.

In one embodiment, the device 100 includes a receptacle 502 configured to receive an attachment pin (not pictured). The attachment pin is shaped to fit a loop in the wristband 104 to hold the device 100 to a user's wrist. Depending on the embodiment, the attachment pin is made of metal, plastic, ceramic or another material suitable to hold the wristband 104 to the device 100. Also depending on the embodiment, the band 104 is made of metal, leather, or any other material capable of securely holding the device 100 to a user's wrist. Because currents of a slot antenna in accordance with the present teachings flow inside the slot area, objects made of metal or any other materials placed in contact with an external surface of the front housing 202 do not affect antenna performance. Thus, if the device 100 is fitted with a metal attachment pin and/or wristband, the antenna 316 maintains its transmission properties and thus there is no need to retune the antenna.

Figure 6:
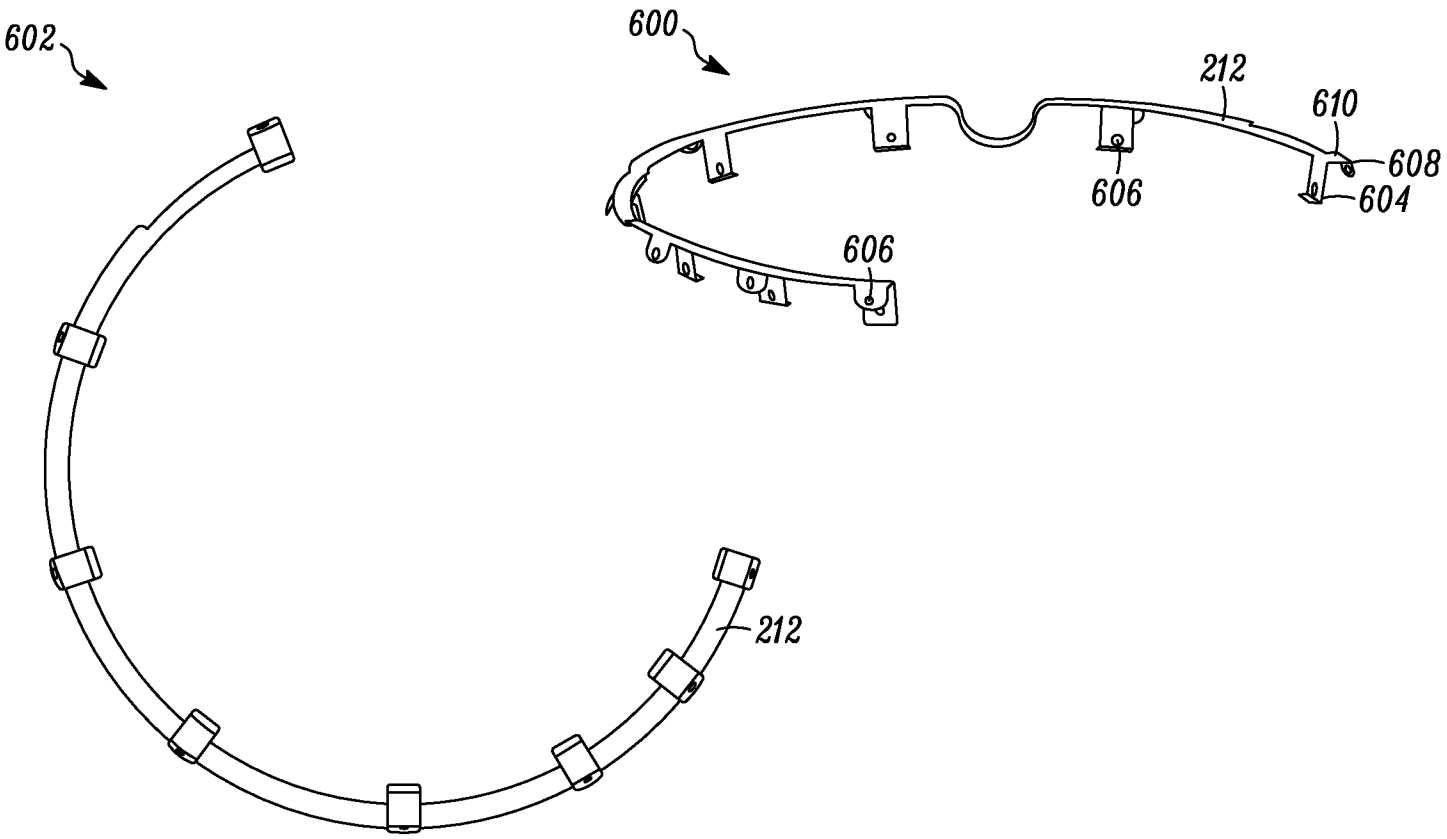
FIG. 6 illustrates two views of a contact element for an antenna system in accordance with an embodiment.

FIG. 6 shows two views 600 and 602 of the contact element 212 and its extensions 610. As previously described, the extensions are configured to perform various functions including frequency setting and frequency suppression. The views 600, 602 illustrate that the contact element 212 is formed into a single piece of metal. Thus, as FIG. 3 in conjunction with FIG. 6 show, the first and second frequency setting elements 306 and 308 and at least one frequency suppression element 310 are constructed into a single piece of metal, such as the contact element 212. Further, the single piece of metal is curved. Because the contact element 212 is disposed on an upper edge 506 of the rear housing 214 that is substantially concentric with the front housing component 202, the single piece of metal has a curvature that corresponds to a curvature of the outer housing 202 of the wearable electronic device 100. Further, the front housing component 202 has a cylindrical shape (see FIG. 2), and the contact element 212 has a semi-circular shape that conforms to the cylindrical shape of the front housing 202 and that sits within the rear housing component 214.

The extensions 610 span downward from a top portion of the contact element 212 to form a "U" shaped piece, which is capable of receiving the upper edge 506 of the rear housing 214. When the contact element 212 is disposed on the rear housing 214, a first side 608 of the contact element 212 is positioned to contact the first conductive surface 326 and a second side 604 is positioned to contact the second conductive surface 328.

Each of the first 608 and second 604 sides of the extensions 610 have a spherical protrusion 606 which serves as a contact point between the contact element 212 and other surfaces, such as the first 326 and second 328 conductive surfaces. When the device 100 is assembled, the front housing component 202 is positioned over the rear housing component 214 such that the extensions 610 of the contact element 212 flex to connect the first conductive surface 326 to the second conductive surface 328, at least at the spherical protrusions 606.

Figure 7:
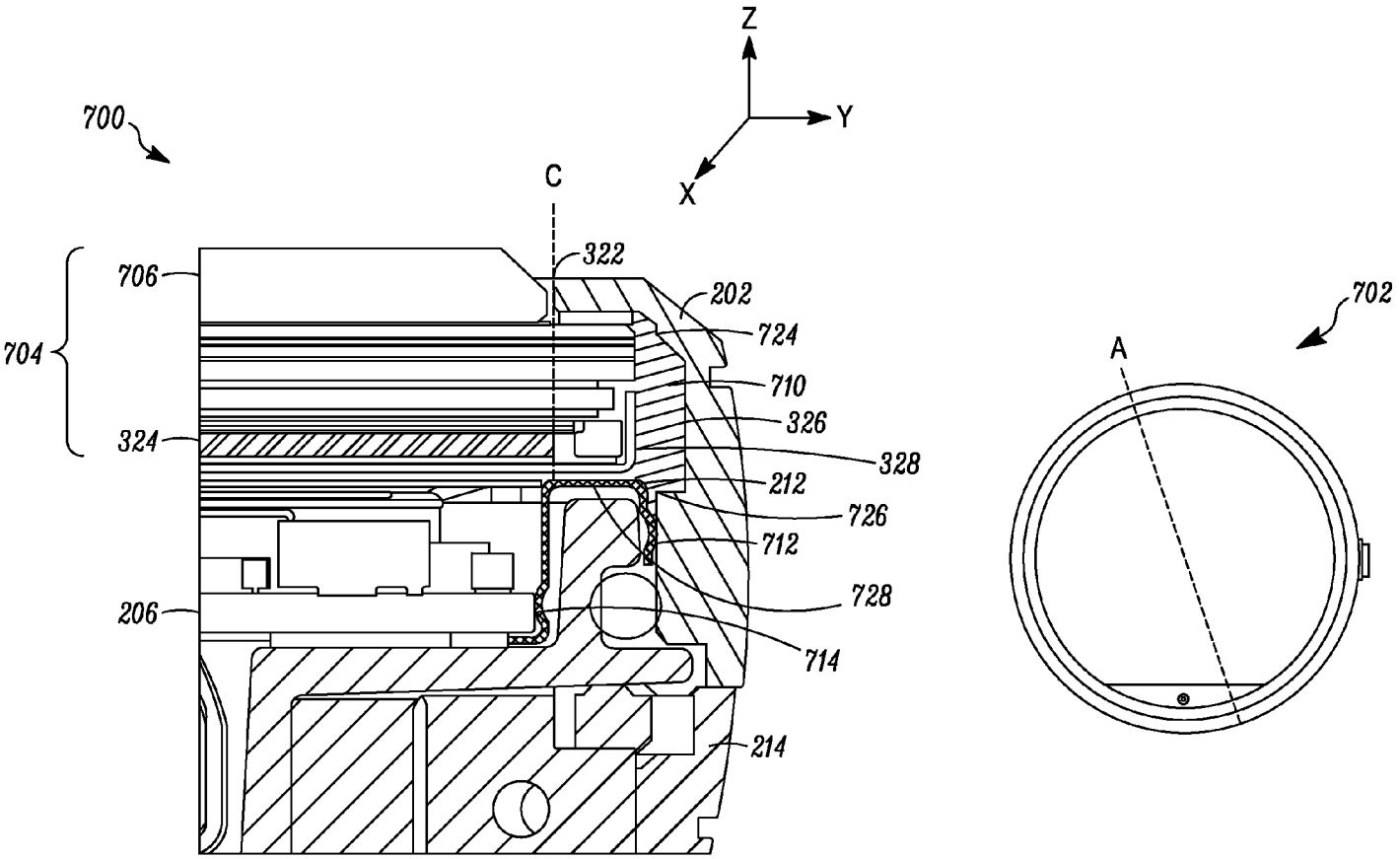
FIG. 7 illustrates a cross-sectional view and an overhead view of components of a wearable electronic device configured with an antenna system in accordance with an embodiment.

FIG. 7 illustrates views 700 and 702 showing aspects of the contact between the contact element 212 and the first 326 and second 328 conductive surfaces of the device 100. Views 700 and 702 also show the display 324 within a display assembly 704, and the first 326 and second 328 conductive surfaces in greater detail. A location of a cross-section 'A' through the device 100 is illustrated in the overhead view 702. The view 700 shows a cut-away view of the device 100 at the cross-section 'A'.

The display assembly 704 includes a lens 706, the display 324, and other components, for instance various other layers as described above for an LCD display. The display 324 is configured to generate an image that is projected through the lens 706 to a user of the device 100. The display 324 is arranged within the device 100 such that the edge 330 of the surface of the display 324 aligns with the second edge 322 of the front housing component 202. The alignment of the edge 330 of the display 324 with the second edge 322 is illustrated at 'C'.

View 700 also shows a leg 728 of the contact element 212, which represents a feeding element, a frequency suppression element, or a frequency setting element. When the contact element 212 is disposed on the lower housing 214 and the lower housing 214 is assembled with the front housing 202, the legs of the contact element 212 are compressed along one or both of the X and Y axes. This compression allows a feeding element, for instance, of the contact element 212 to connect the first conductive surface 326 to the second conductive surface 328 along a plane (in this case the X-Y plane) that is normal to the first conductive surface 326 (in this case the Z axis).

In one example, the leg 728 is compressed to connect the first conductive surface 326 at a contact point 712 and the second conductive surface 328 at another contact point 714. The leg 728 exerts a force in the X-Y plane to maintain the contact points 712 and 714 with the first 326 and second 328 conductive surfaces, respectively. In one particular example, the extension 728 is a feeding element which connects at the contact point 714 a segment of the PCB 206, which is one of the contacting metal components of the second conductive surface 328, to the first conductive surface 326 at the contact point 712.

When the device is assembled, a space 710, which illustratively forms portion of the slot antenna, is formed between the first conductive surface 326 and the second conductive surface 328. This space 710 varies in size and dimension depending on in which cross-section of the device 100 the space 710 is created. The variations in the size of the space between the first and second conductive surfaces sometimes differ because of the arrangement of the set of contacting metal components composing the second conductive surface 328 in spatial relationship to the first conductive surface 326. In other cases, a portion of the front housing component 202 has a different thickness at different locations, which affects the dimensions of the space 710.

Figure 8:
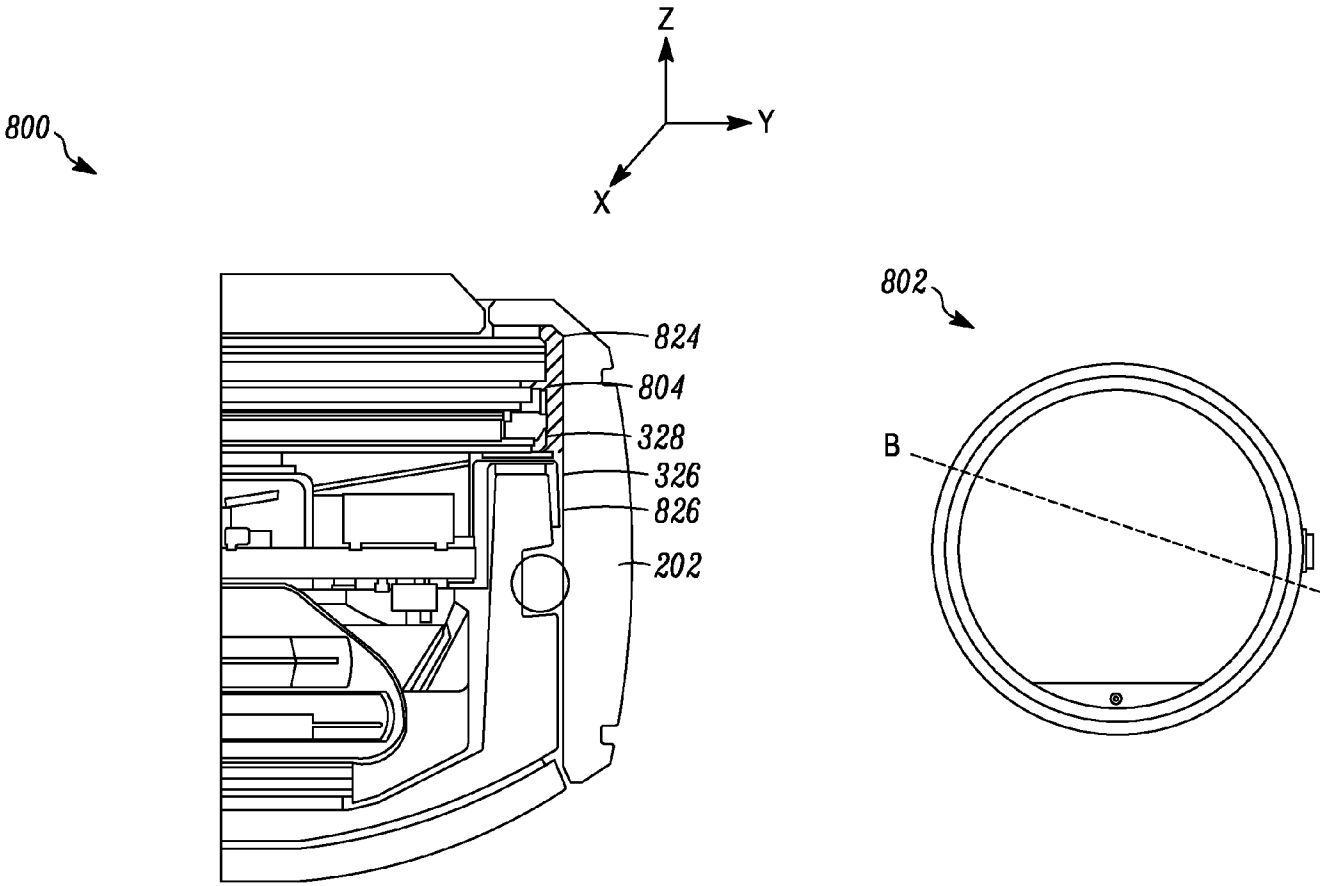
FIG. 8 illustrates another cross-sectional view and overhead view of components of a wearable electronic device configured with an antenna system in accordance with an embodiment.

FIG. 8 shows views 800 and 802 to allow the comparison of aspects of FIG. 8 with FIG. 7. A location of a cross-section 'B' through the device 100 is illustrated in the overhead view 802. The view 800 shows a cut-away view of the device 100 at the cross-section 'B'. Similar, to the cross-section illustrated in FIG. 7, the device 100 is configured to have a space 804 between the first conductive surface 326 and the second conductive surface 328. The space 804 illustrated in FIG. 8, however, is smaller than the space 710 between the first 326 and the second 328 conductive surfaces illustrated in FIG. 7. The difference in the size of the space between the two conductive surfaces is attributable to a cut or core-out partially shown in FIG. 7. At cross-section 'A', a portion of the front housing 202 stretching from 724 to 726 is "cored-out" to facilitate communicating electromagnetic waves using the antenna system of the present teachings. This same region 824, 826 remains intact at cross-section 'B' illustrated in view 800 to facilitate suppressing unwanted frequencies. Consequently the space 710 between first conductive surface 326 and the second conductive surface 328 in view 700 is larger than the space 804 illustrated in view 800. This change in the size of the spaces 710, 804 shows that at least one dimension of the space 710, 804 between the first 326 and second 328 conductive surfaces changes.

Figure 9:
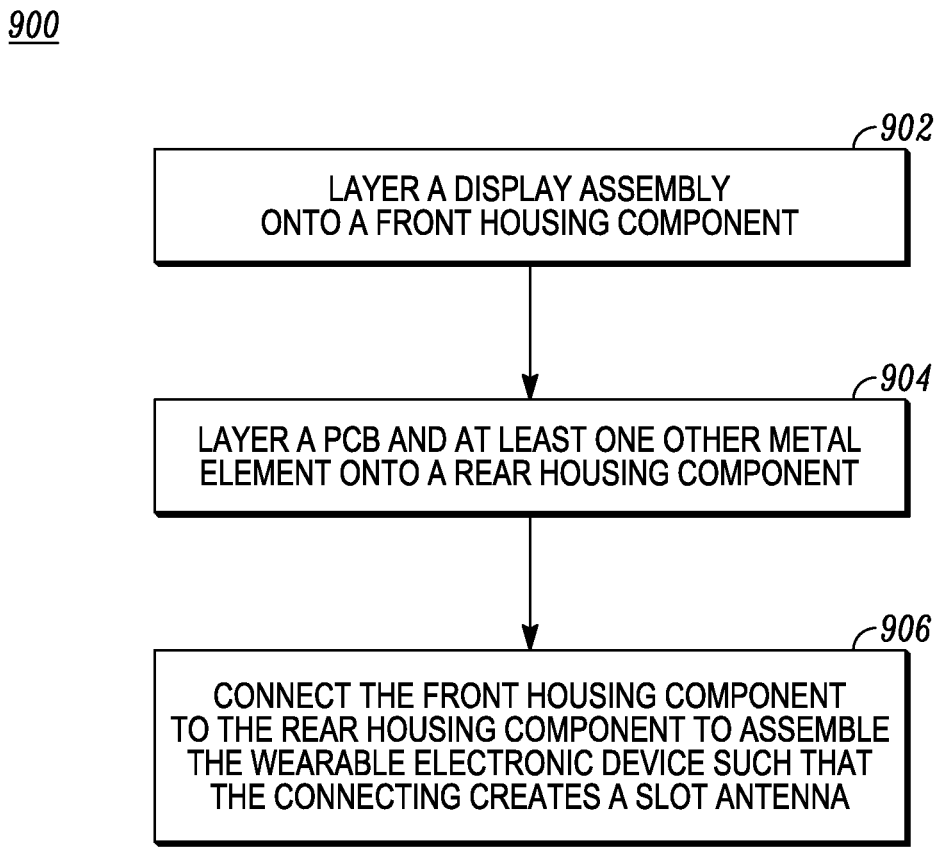
FIG. 9 shows a flow diagram illustrating a method for assembling a wearable electronic device having a slot antenna in accordance with an embodiment.

FIG. 9 illustrates is a method 900 for assembling a wearable electronic device having a slot antenna. In one example, the method includes layering the contact element 212, the printed circuit board 206, and the display 324 onto at least one of the rear housing component 214 or the front housing component 202. In the particular embodiment illustrated by reference to method 900, a display assembly, e.g., 704 of FIG. 7, is layered 902 onto and bonded to the front housing component 202. Moreover, the PCB 206 and at least one other metal component, for instance as shown in FIG. 2, is layered 904 onto the rear housing component 214.

The method 900 also includes connecting 906 the front housing component 202 to the rear housing component 214 to assemble the wearable electronic device 100 such that a lateral surface of the front housing component 202 extends along the Z axis. The layering is performed in the Z axis which is normal to a face of the display 324. This layering entails applying forces along the Z axis to bring these components together. Connecting the front housing component 202 to the rear housing component 214 creates a slot antenna having an aperture 316 in accordance with the present teachings, for instance as described above by reference to FIGS. 1 to 8.

In the particular embodiment described by reference to FIGS. 1 to 8, layering the contact element comprises disposing adjacent to a cylindrical rear housing component 214 a semi-circular metallic ring 212 having formed therein the feeding element 304. Connecting the front housing component 202 to the rear housing component 214 comprises connecting a cylindrical front housing component 202 to the cylindrical rear housing component 214 to assemble a wrist-worn electronic device 100.

The disclosed device 100 illustrated a cylindrical front housing 202 with a circular face. In other embodiments, however, the front housing is configured with other shaped exteriors to present a front housing that is not cylindrical and a face that is not circular. For example, the front housing 202 disclosed herein can be configured, for example, with a square face that extends downward to blend with the cylindrical rear housing such that the housing is not perfectly cylindrical and the face is square. In still other embodiments, the housing and/or face is constructed with other shapes consistent with wearable electronic devices having different outer appearances.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus.

An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically.

A device or structure that is "configured" in a certain way is configured in at least that way, but may also be configured in ways that are not listed. As used herein, the terms "configured to", "configured with", "arranged to", "arranged with", "capable of" and any like or similar terms mean that hardware elements of the device or structure are at least physically arranged, connected, and or coupled to enable the device or structure to function as intended.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An antenna system for a wearable electronic device, the antenna system comprising:

an outer housing of the wearable electronic device, the outer housing including a first conductive continuous surface, the first conductive continuous surface spanning a first axis through the wearable electronic device and extending along a same direction as the first axis, the first axis being normal to a plane that is parallel to a center opening in the outer housing; and a set of contacting metal components and a contact element that are internal to the wearable electronic device, the set of contacting metal components including adjacent metal surfaces of each of the set of contacting metal components, the adjacent metal surfaces and the contact element forming a second conductive surface;

the second conductive surface spanning and extending along the first axis and separated by a space from the first conductive continuous surface, the second conductive surface being internal to the outer housing of the wearable electronic device; and the contact element having a feeding element that connects the first conductive continuous surface to the second conductive surface.

2. The antenna system of claim 1, wherein the contact element further comprises a set of legs that includes a first leg that is located coincident with a first end of a slot antenna formed from the first conductive continuous surface and the second conductive surface and a second leg that is located coincident with a second end of the slot antenna, wherein the feeding element is located between the first and second legs.

3. The antenna system of claim 2, wherein the first and second legs comprise first and second frequency setting elements the locations of which control a radiating frequency for the slot antenna.

4. The antenna system of claim 3, wherein the contact element further comprises at least one frequency suppression element configured to suppress one or more undesired radiating frequencies.

5. The antenna system of claim 4, wherein the first and second frequency setting elements and the at least one frequency suppression element are constructed into a single piece of metal.

6. The antenna system of claim 5, wherein the single piece of metal is curved.

7. The antenna system of claim 6, wherein the single piece of metal has a curvature that corresponds to a curvature of the outer housing of the wearable electronic device.

8. The antenna system of claim 1, wherein the outer housing has a cylindrical shape such that the first conductive continuous surface is curved.

9. The antenna system of claim 1, wherein the feeding element connects a segment of a printed circuit board, which is one of the contacting metal components, to the first conductive continuous surface.

10. The antenna system of claim 1, wherein at least one dimension of the space between the first conductive continuous surface and the second conductive surface changes.

11. The antenna system of claim 1, wherein the plane parallel to the center opening comprises an X-Y plane and the first axis comprises a Z-axis normal to the X-Y plane.

12. The antenna system of claim 1, wherein the first conductive continuous surface is constructed from a segment of the outer housing.

13. The antenna system of claim 1, wherein the feeding element connects the first conductive continuous surface to the second conductive surface along a plane that is normal to the first conductive continuous surface.

14. A wearable electronic device comprising:

a rear housing component;

a front housing component connected to the rear housing component at a first edge, the front housing component having an opening at a second opposing edge and a first conductive continuous surface;

internal components at least partially enclosed by the front and rear housing components, the internal components including a display having a surface that spans the opening of the front housing component, a second conductive surface, and a contact element; and an antenna system comprising:

the first conductive continuous surface disposed normal to the surface of the display;

the second conductive surface disposed normal to the surface of the display and separated by a space from the first conductive continuous surface, the second conductive surface comprising adjacent contacting metal surfaces of a set of contacting metal components of the internal components; and the contact element having a feeding element that connects the first conductive continuous surface to the second conductive surface.

15. The wearable electronic device of claim 14 further comprising a metal component connected to an outside surface of the front housing component proximal to the first conductive continuous surface.

16. The wearable electronic device of claim 14, wherein the set of contacting metal components of the internal components comprises a printed circuit board disposed adjacent to the rear housing component, wherein the printed circuit board includes a communication element configured to wirelessly communicate using the antenna system, wherein the set of contacting metal components further comprises a shield disposed adjacent to the printed circuit board and a display bezel disposed adjacent to the shield and the display, wherein the feeding element connects the communication element on the printed circuit board to the first conductive continuous surface of the antenna system.

17. The wearable electronic device of claim 14, wherein the front housing component has a cylindrical shape, and the contact element has a semi-circular shape that conforms to the cylindrical shape of the front housing component and that sits within the rear housing component.

18. The wearable electronic device of claim 17, wherein the contact element further comprises at least first, second, and third extension members, wherein the first and second extension members are configured to set a desired radiating frequency for the antenna system, and the third extension member is configured to suppress an undesired radiating frequency.

19. A method for assembling a wearable electronic device having a slot antenna, the method comprising:

layering, along a first axis, a contact element, a printed circuit board, and a display onto at least one of a rear housing component or a front housing component, the front housing component including a first conductive continuous surface, the layering creating a second conductive surface from adjacent contacting metal surfaces of each of the contact element, the printed circuit board, and the display; and connecting the front housing component to the rear housing component to assemble the wearable electronic device such that the first conductive continuous surface of the front housing component extends along the first axis, the connecting creating a slot antenna comprising:

the first conductive continuous surface;

the second conductive surface disposed along the first axis and separated by a space from the first conductive continuous surface; and the contact element, the contact element including a feeding element that connects the first conductive continuous surface to the second conductive surface.

20. The method of claim 19, wherein layering the contact element comprises disposing adjacent to a cylindrical rear housing component a semi-circular metallic ring having formed therein the feeding element, and connecting the front housing component to the rear housing component comprises connecting a cylindrical front housing component to the cylindrical rear housing component to assemble a wrist-worn electronic device.

* * * * *